US009097046B2

(12) United States Patent
Baer

(10) Patent No.: US 9,097,046 B2
(45) Date of Patent: Aug. 4, 2015

(54) HINGE WITH ARTICULATING COVER SYSTEM

(75) Inventor: Austin R. Baer, Sarasota, FL (US)

(73) Assignee: Von Duprin LLC, Carmel, IN (US)

( * ) Notice: Subject to any disclaimer, the term of this patent is extended or adjusted under 35 U.S.C. 154(b) by 0 days.

(21) Appl. No.: 14/126,742

(22) PCT Filed: Jun. 13, 2012

(86) PCT No.: PCT/US2012/042136

§ 371 (c)(1),
(2), (4) Date: Mar. 20, 2014

(87) PCT Pub. No.: WO2012/174039

PCT Pub. Date: Dec. 20, 2012

(65) Prior Publication Data

US 2014/0298616 A1 Oct. 9, 2014

Related U.S. Application Data

(60) Provisional application No. 61/498,176, filed on Jun. 17, 2011.

(51) Int. Cl.

| | |
|---|---|
| ***E05D 15/00*** | (2006.01) |
| ***E05F 1/08*** | (2006.01) |
| ***E05D 11/00*** | (2006.01) |
| ***E05D 3/02*** | (2006.01) |
| ***E05D 7/00*** | (2006.01) |

(52) U.S. Cl.

CPC ..... *E05D 11/0054* (2013.01); *E05D 3/02* (2013.01); *E05D 7/009* (2013.01); *E05Y 2201/712* (2013.01); *Y10T 16/533* (2015.01); *Y10T 29/24* (2015.01)

(58) Field of Classification Search

USPC ..... 16/354, 366, 355, 356, 250, 251, 385, 16/387; 49/383; 160/206, 213, 229.1

See application file for complete search history.

(56) References Cited

U.S. PATENT DOCUMENTS

| | | | | |
|---|---|---|---|---|
| 3,092,870 | A * | 6/1963 | Baer | 16/277 |
| 4,056,985 | A * | 11/1977 | Worrallo | 74/435 |
| 4,443,911 | A * | 4/1984 | Bannister | 16/354 |

(Continued)

OTHER PUBLICATIONS

US Patent Office, Acting as the International Search Authority under the Patent Cooperation Treaty, International Search Report, PCT/US2012/042136, Aug. 14, 2012.

(Continued)

*Primary Examiner* — Chuck Mah
(74) *Attorney, Agent, or Firm* — IpHorgan Ltd.

(57) ABSTRACT

A pinned hinge with articulating cover system and associated method for assembly are provided. In one embodiment, the hinge includes first and second hinge members pivotally coupled together. A plurality of geared bearing inserts are mounted to knuckles of the hinge members. A cover adapter clip is mounted on the knuckles that is configured to movably engage the geared bearing inserts. A cover is mounted on the cover adapter clip to complete the cover system. Opening and closing leaves of the hinge members displaces the cover to prevent interference with the hinge members during operation. The cover adapter clip and cover are resiliently structured in some embodiments to facilitate lateral assembly of the clip and cover to the hinge for convenience of installation. The geared bearing inserts further include an integral load bearing portion and provide vertical load-bearing support for the hinge.

30 Claims, 36 Drawing Sheets

(56) References Cited

U.S. PATENT DOCUMENTS

| | | | | |
|---|---|---|---|---|
| 4,765,027 | A * | 8/1988 | Andric | 16/354 |
| 4,999,879 | A | 3/1991 | Baer | |
| 5,062,181 | A | 11/1991 | Bobrowski et al. | |
| 5,443,444 | A * | 8/1995 | Pruyssers | 602/26 |
| 5,991,975 | A | 11/1999 | Baer | |
| 6,859,980 | B2 | 3/2005 | Baer | |
| 7,406,748 | B2 * | 8/2008 | Baer | 16/354 |
| 2003/0226238 | A1 | 12/2003 | Baer | |
| 2004/0034968 | A1 * | 2/2004 | Williams | 16/354 |
| 2007/0094846 | A1 * | 5/2007 | Ishida | 16/354 |
| 2009/0313790 | A1 * | 12/2009 | Schau | 16/354 |

OTHER PUBLICATIONS

US Patent Office, Acting as the International Preliminary Examining Authority under the Patent Cooperation Treaty, International Preliminary Report on Patentability, PCT/US2012/042136, Jul. 26, 2013.

* cited by examiner

HINGE WITH ARTICULATING COVER SYSTEM

The present application claims the benefit of priority to U.S. Provisional Application No. 61/498,176 filed Jun. 17, 2011, the entire contents of which is incorporated herein by reference.

FIELD OF THE INVENTION

The present invention generally relates to pinned barrel type hinges, and more particularly to an improved cover and hinge support system for a pinned barrel hinge.

BACKGROUND OF THE INVENTION

Pinned barrel type hinges are used for pivotably connecting a pair of hinged objects together, such as in a conventional door-to-frame or door-to-door arrangement. Pinned hinges include at least two hinge members each having leaves that are attached to hinged objects to be pivotably joined. The leaves generally each have one or more barrels or "knuckles" that are interspersed with knuckles from the mating leaf. The knuckles define concentrically aligned cylindrical bores extending longitudinally therethrough. A pin is inserted through the bores of the knuckles of both leaves, thereby pivotably connecting the leaves and hinged objects together.

One type of pinned hinge is known in the art as a "butt" or "mortise" hinge. In butt hinges, the length of each pair of leaves and pin is longitudinally short compared to the overall height or length of the door or other hinged object mounted to the hinge. Accordingly at least two or more of these hinges longitudinally spaced along the height or length of a door may be used to connect a movable door to its mating stationary door frame or to connect two or more movable doors together.

Another type of pinned hinge is known in the art as a "continuous" hinge. Hinges that are continuous extend longitudinally and attach a door to its frame or to another door for a substantial part of the entire height or length of the joined portions of the doors/frames. Such hinges take various forms, including hinges which are formed from sheet metal leaf by stamping and curling "knuckles" along the length of the leaf which typically extends longitudinally for substantially the entire height or length of the hinged object. The knuckles are separated by spaces of generally equal length so that the opposing knuckles of a first hinge member may be interposed between the knuckles of a first hinge member similarly to a butt hinge. All knuckles are then pivotally connected together by a long pin or rod having a length generally at least equal to the entire combined length of all joined knuckles. Such hinges are also commonly known as "piano" hinges, and may be used in numerous applications including pivoting the covers for piano keyboards, for athletic lockers, furniture, equipment enclosures, for building architectural doors and frames, or wherever a secure hinging system is required.

An improved pinned hinge is desired.

SUMMARY OF THE INVENTION

A pinned hinge is provided which may be in the form of a butt or continuous type pinned hinge having at least two pivotably connected hinge members joined by a pin and a mechanically articulated cover system. Embodiments of the cover system may include one or more drive members which are mounted to the hinge members and an elastically resilient cover adapter clip having one or more driven members mechanically coupled to the drive members for imparting inward and outward articulated movement to the adapter clip with respect to the pin as the hinge is opened and closed. In one embodiment, the drive members may be gear segments or sectors and the driven members may be gear racks. The gear sectors may be formed on geared bearing inserts in one embodiment which are mounted to the hinge members, as further described herein.

A cover is provided that mounts to the cover adapter clips for concealing and protecting the hinge knuckles and cover adapter clip. Unlike the cover adapter clip, because the cover itself need not include a gear rack for mechanically articulating the cover assembly, the cover may be configured as primarily an aesthetically pleasing and protective outer shell structure having a relatively thin wall in comparison to the cover adapter clips or the leaves. Accordingly, embodiments of the cover include roll formed, stamped, or extruded thin walled metal covers which are relatively inexpensive to produce and may be provided in a variety of metals and finishes. In preferred embodiments, the cover may be elastically resilient and attaches to the cover adapter clip via a frictional snap fit. Similarly, the cover adapter clip may be elastically resilient and attaches to the geared bearing inserts and hinge members via a frictional snap fit.

The geared bearing inserts advantageously further incorporate and provide a load bearing system for carrying vertical hinge loads. Both the geared bearing inserts and cover adapter clip may be made of elastically deformable polymer in various embodiments, such as without limitation nylon or polyoxymethylene (POM), also known as acetal, polyacetal, and polyformaldehyde, an engineering thermoplastic used in precision parts that require high stiffness, low friction and dimensional stability.

As further described herein, the displaceable cover system prevents interference between the cover and hinge members during operation of the hinge (i.e. opening and closing).

Advantageously, embodiments of the present invention provide an economical articulating cover and load bearing system for pinned hinges because the preferably thin-walled metallic roll-formed or stamped cover is primarily a thin and at least partially flexible non-structural decorative element whereas the load bearing operating element that mechanically couples to the geared bearing inserts on the hinge members is the cover adapter clip; the latter which may be inexpensively produced of molded polymer. In alternative embodiments, however, the cover adapter clip may also be made of metal. In yet other embodiments, there is the possibility of using a different material for the cover adapter clip than is used for the geared insert to reduce friction and improve wear between the gear insert and the cover adapter clip, such as without limitation polyacetal plastic for the geared insert (which is commonly used for plastic gears for stiffness or hardness) and nylon for the cover adapter clip (for flexibility as a "snap-on" part). Using dissimilar materials for interfacing moving parts provides the opportunity to reduce wear and friction.

According to one embodiment of the present disclosure, a pinned hinge with articulating cover system includes a longitudinal axis, a first hinge member including a first drive member mounted on the first hinge member, a second hinge member including a second drive member mounted on the second hinge member, a pin pivotally connecting the first and second hinge members together, an inner cover adapter clip having a first driven member mechanically coupled to the first drive member and a second driven member mechanically coupled to the second drive member, wherein angularly opening and closing the first and second hinge members displaces the cover adapter clip with respect to the pin, and an outer cover mounted on the cover adapter clip and having a configuration complementary to the configuration of the cover adapter clip, the cover being movable with the clip. In one embodiment, the first drive member is a first geared bearing insert having a geared portion with a plurality of teeth; the geared portion being engaged with the first driven member. In another or the same embodiment, the first driven member is a first gear rack having a plurality of teeth being engaged with the geared portion of the first geared bearing insert. The teeth of the gear rack may be arranged in a linear or straight manner on a relatively flat interior surface inside the cover adapter clip and protrude inwardly into a cavity in the clip. The teeth of the geared portion of the geared bearing insert may be arranged in a convexly curved or arcuate fashion and protrude radially outwardly from an exterior surface of the geared bearing insert to engage the gear racks of the cover adapter clip.

According to another embodiment of the present disclosure, a pinned hinge with articulating cover system includes a longitudinal axis, a first hinge member including a first leaf having at least a first knuckle, a second hinge member including a second leaf having at least two second and third knuckles, the first knuckle of the first hinge member being interspersed between the second and third knuckles, and a pin pivotally connecting the first and second hinge members together for pivoting opening and closing movement. A first pair of adjacent geared bearing inserts is disposed between a first end of the first knuckle and the second knuckle, each geared bearing insert of the first pair being removably mounted to the first or second knuckles and including a toothed geared portion and a bearing portion. A second pair of adjacent geared bearing inserts is disposed between a second end of the first knuckle and the third knuckle, each geared bearing insert of the second pair being removably mounted to the first or third knuckles and including a toothed geared portion and a bearing portion. An elongated cover adapter clip including a plurality of toothed gear racks is mechanically coupled to first and second hinge members by engagement with the geared bearing inserts, wherein angularly opening and closing the first and second hinge members displaces the cover adapter clip with respect to the pin. An elongated cover is mounted on the cover adapter clip and is movable with the clip by opening and closing the first and second hinge members.

According to one embodiment of the present disclosure, an articulating cover system for a pinned hinge includes a plurality of geared bearing inserts, each geared bearing insert being configured for detachable mounting on a knuckle of a hinge leaf and including a geared portion comprising a gear tooth segment and a bearing portion having an annular load bearing surface. At least one cover adapter clip is provided having a substantially U-shaped body in cross section defining an open bottom and a central cavity configured for receiving the geared bearing inserts. The cover adapter clip includes a plurality of gear tooth racks configured for movable coupling to the geared portions of the geared bearing inserts, wherein rotation of at least some of the geared bearing inserts when mounted on knuckles of the hinge leaf displaces the cover adapter clip with respect to the geared bearing inserts. A cover configured for detachable mounting on the cover adapter clip is provided having a complementary shape substantially conforming to the outer or exterior surface of the cover adapter clip. The cover is movable with the cover adapter clip when mounted thereon. In one embodiment, the cover adapter clip further includes a bearing locking groove configured to receive the bearing portions of the geared bearing inserts. In another or the same embodiment, the cover adapter clip includes a raised stop portion configured and dimensioned to fit over a knuckle of a hinge leaf.

According to another embodiment of the present disclosure, a method is provided for attaching an articulating cover system to a pinned hinge. In one embodiment, the method includes: providing a first hinge member having a pair of spaced apart first and second knuckles defining an axial passageway configured for receiving a hinge pin; providing a second hinge member having a third knuckle defining an axial passageway configured for receiving a hinge pin; providing a plurality of geared bearing inserts each having a geared portion comprising gear teeth and an integral bearing portion comprising an annular load bearing surface; mounting a geared bearing insert on each of opposite ends of the third knuckle of the second hinge member;

mounting a gear bearing insert on an end of each of the first and second knuckles that is proximate most to the other knuckle of the first hinge member; inserting the third knuckle of the second hinge member between the first and second knuckles of the first hinge member, wherein the geared bearing inserts on each end of the third knuckle are adjacent to one of the geared bearing inserts on the first or second knuckle; aligning the passageways of the first and second knuckles with the passageway of the third knuckle; axially inserting a hinge pin through the first, second, and third knuckles; engaging a cover adapter clip having a plurality of gear racks with the geared bearing inserts on the hinge; and attaching a resiliently configured snap-on cover onto the cover adapter clip. In one embodiment, the cover adapter clip has a resiliently open bottom defining an internal cavity and the first attaching step above includes laterally pushing the clip over the knuckles and geared bearing inserts. In another or the same embodiment, the second attaching step above includes laterally pushing and expanding the cover over the cover adapter clip.

BRIEF DESCRIPTION OF THE DRAWINGS

The features of the preferred embodiments will be described with reference to the accompanying drawings described herein where like elements are labeled similarly, and in which.

Figure 1:
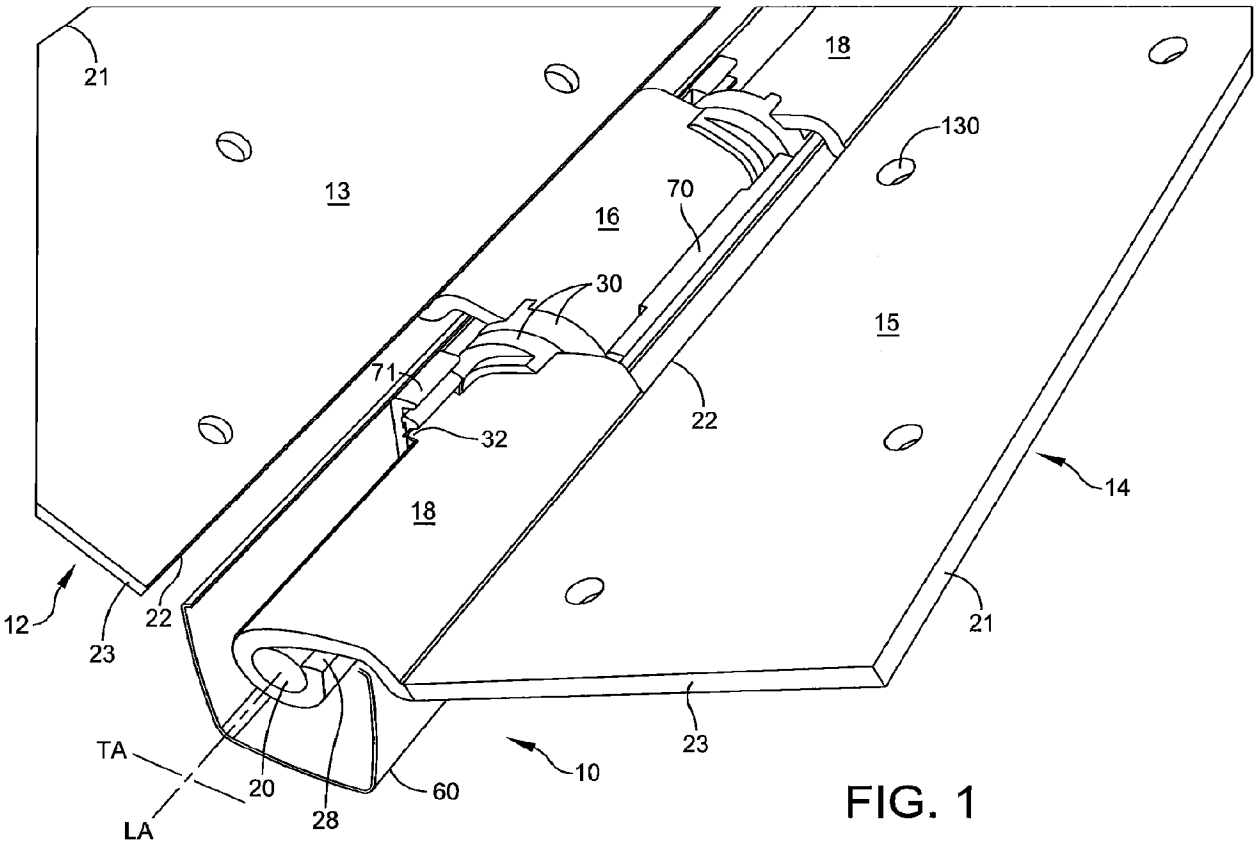
FIG. 1 is a perspective view of a pinned hinge according to one exemplary embodiment of the present invention.
Figure 2A:
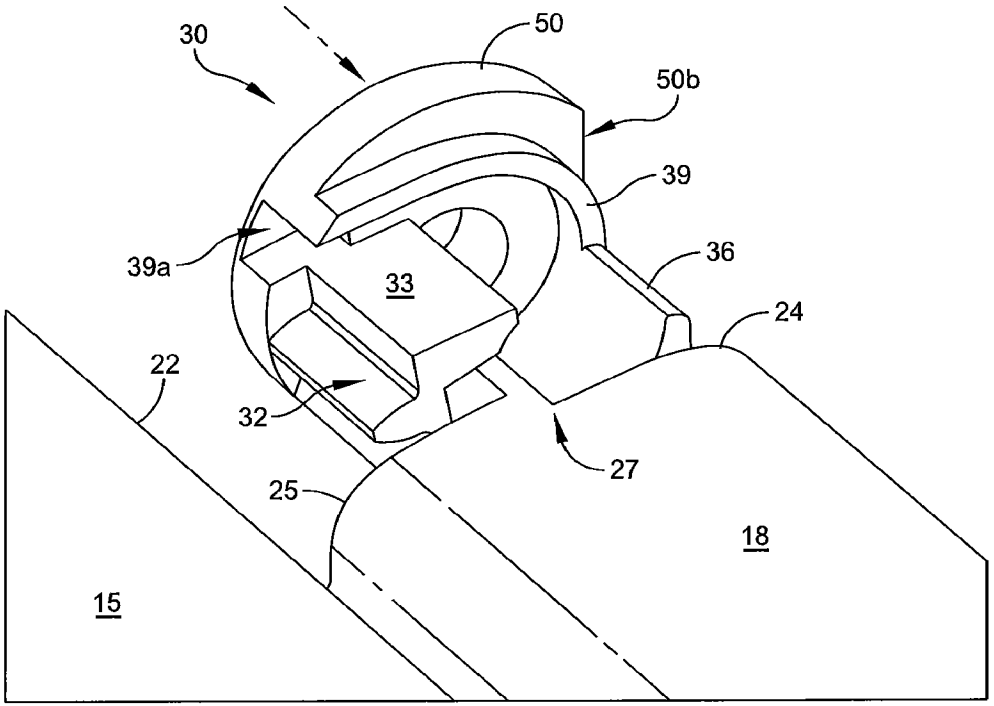
FIGS. 2A-2D show various exploded perspective views in sequence of a pair of adjacent knuckles with geared bearing inserts being mounted onto the hinge of FIG. 1.
Figure 2B:
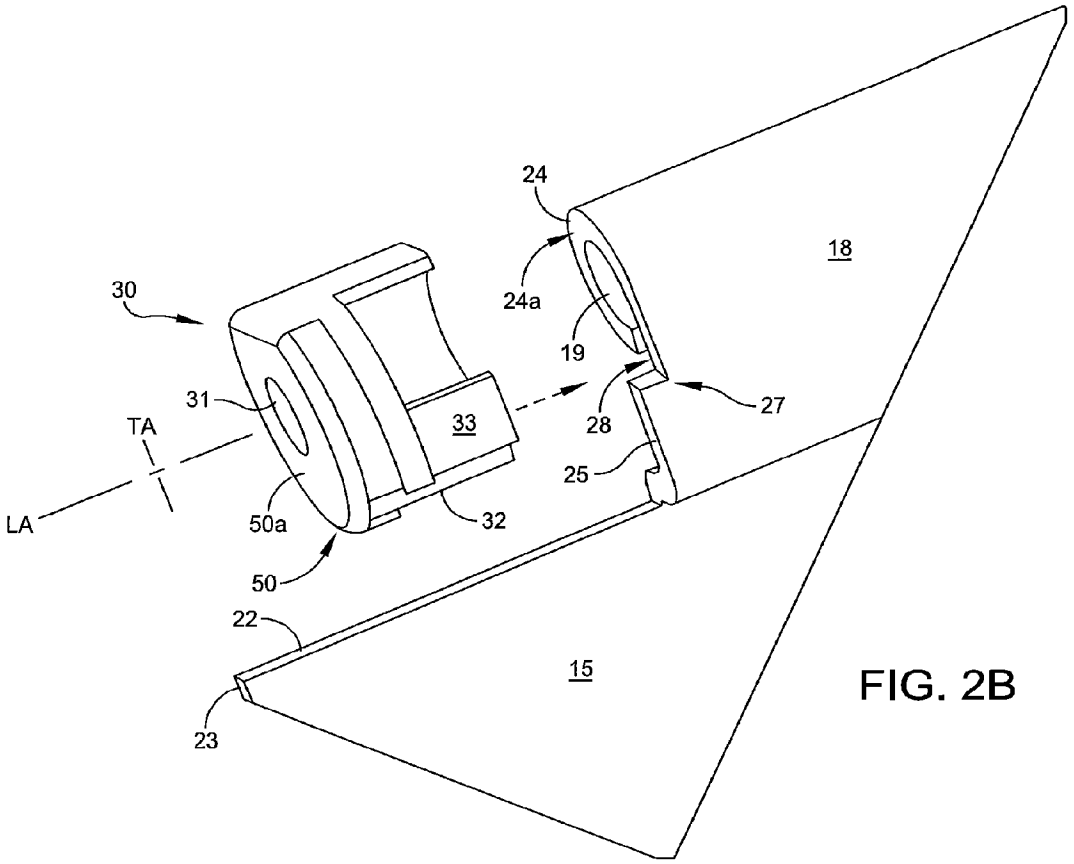
Figure 2C:
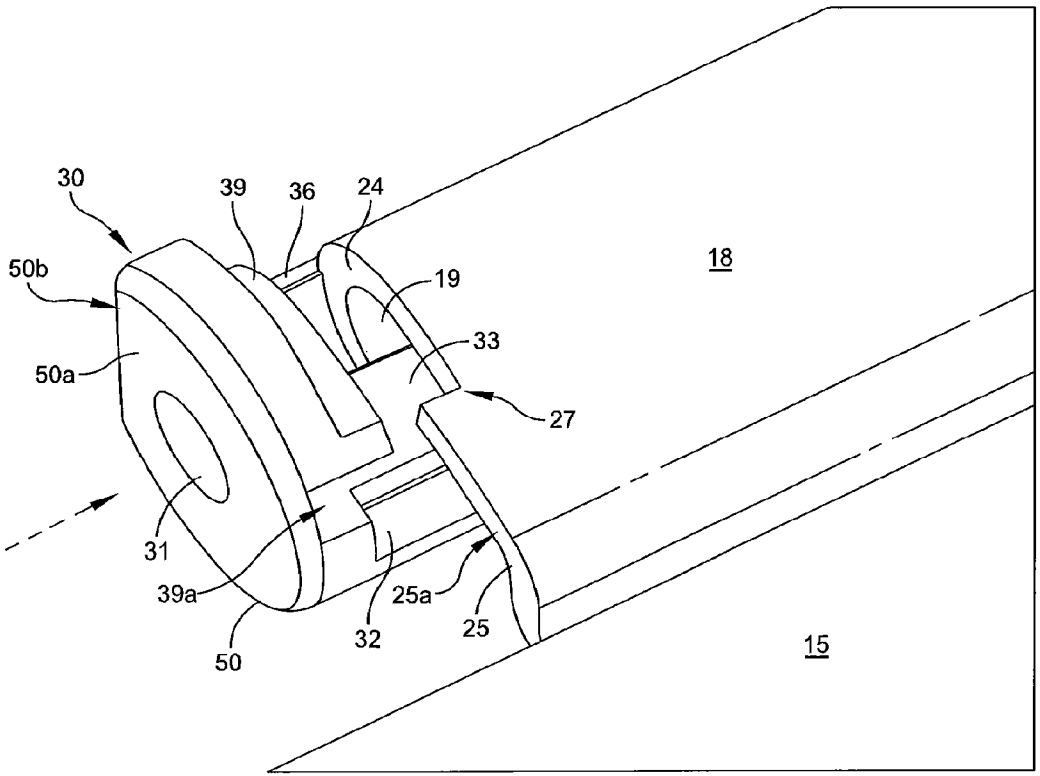
Figure 2D:
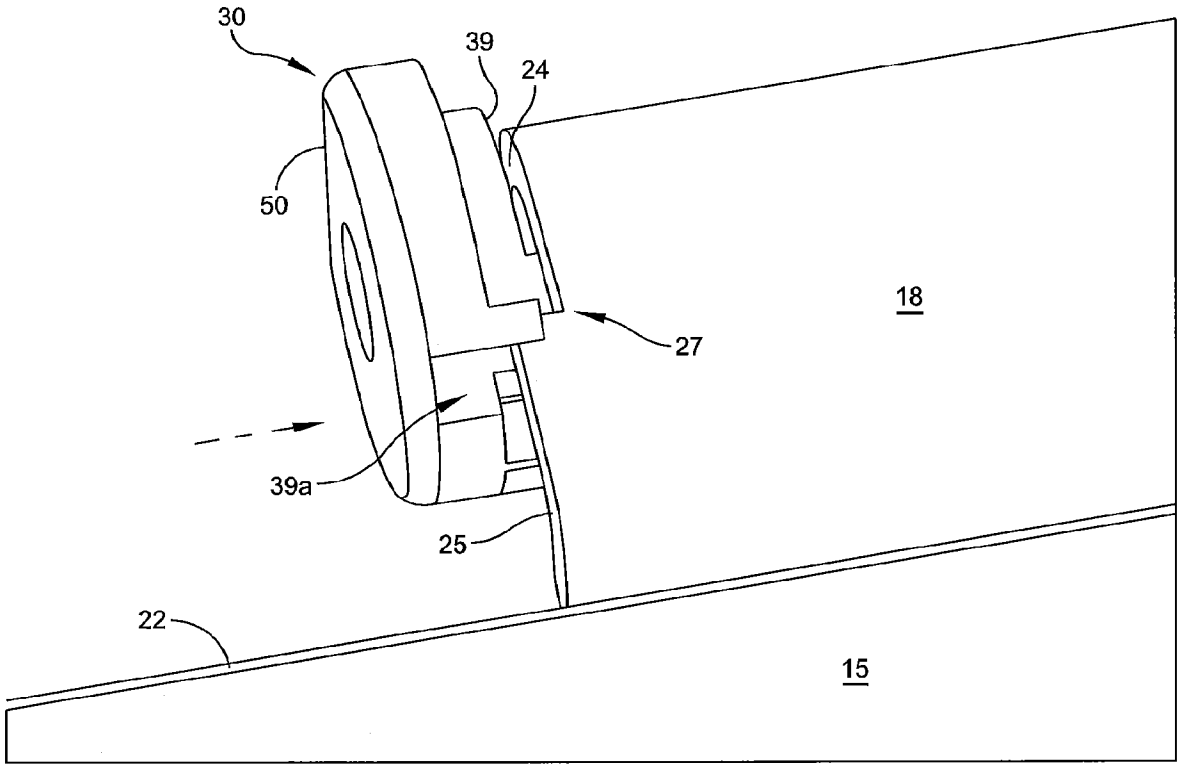

All drawings are schematic and not actual physical representations of the articles, components or systems described herein, and are further not drawn to scale. The drawings should be interpreted accordingly.

DETAILED DESCRIPTION OF PREFERRED EMBODIMENTS

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

The term "longitudinal" is given its ordinary meaning herein and used with respect to orientation to refer to a direction lying or extending along the length of the hinge (i.e. barrels/knuckles and pin) and longitudinal axis LA, as shown in FIG. 1. The terms "transverse" is given its ordinary meaning herein and used with respect to orientation to refer to a direction lying or extending across the width of the hinge and transverse axis TA, as shown in FIG. 1. Accordingly, transverse axis is defined as herein as being generally perpendicular to longitudinal axis LA.

FIG. 1 illustrates one preferred embodiment of an improved pinned hinge 10 which may be in the form of a portion of a butt (as shown) or continuous type pinned hinge that includes a mechanically articulating hinge cover system with integrated bearing support system for the hinge. Hinge 10 is shown with its underside exposed and in a fully open position in FIG. 1. Although the pinned butt hinge 10 embodiment of FIG. 1 may have a total of three knuckles as shown, other embodiments of butt hinges may have a five or more knuckles.

It will be appreciated that the operating principle and discussion to follow is the same whether the articulating cover and bearing system are used in a longitudinally short butt hinge or elongated continuous hinge. Accordingly, the invention is not limited in its application to either butt or continuous type pinned hinges alone.

Pinned hinge 10 includes at least two pivotally connected hinge members 12, 14 each having leaves 13, 15 with barrels or knuckles 16, 18, respectively joined by an axially extending pin 20. In one embodiment, pin 20 has a longitudinal length approximately equal to the combined longitudinal length of all the joined knuckles 16, 18 of hinge 10 so that the ends of the pin are essentially flush with each of the outermost end knuckles. In an alternate construction, the pin may be made shorter at one or both ends to allow for plugs or screws to be inserted into a portion of the endmost knuckle(s) to prevent the pin from moving longitudinally within the knuckles. In a preferred embodiment, self-threading screws with a body diameter slightly greater than the pin diameter are used to retain the pin in position, which can facilitate trimming a continuous hinge to fit the height of the door by first removing a screw from one or both ends and replacing the screws(s) after the hinge leaves and the pin are cut to their appropriate lengths. Alternatively, one or more knuckles of the same leaf may be crimped or staked to the pin to prevent its relative movement if one or both ends of the hinge are trimmed to length. In the embodiment shown, leaves 13, 15 each include a pair of parallel spaced longitudinally-extending lateral sides including an outer lateral side 21 and inner lateral side 22 defining a width of each leaf. Knuckles 16, 18 are formed at inner lateral side 22. Leaves 13, 15 terminate at a pair of opposing transversely extending ends 23 spanning between outer and inner sides 21, 22 that define a width of each leaf.

Leaves 13, 15 are configured and structured for attachment to hinged objects which are pivotally connected together for relative movement to each other, such as for example without limitation, a conventional vertically hung door and door frame jamb (not shown). Typically, one hinge member is attached to one hinged object (e.g., a door) while the other hinge member is attached to the other hinged object (e.g., a door frame). The leaves 13, 15 may be any suitable shape and thickness, dependent upon the particular installation requirements. In some embodiments, leaves 13, 15 may be a structurally stiffened design and configured as disclosed in U.S. Pat. No. 7,406,748, which is incorporated herein by reference in its entirety. Leaves 13, 15 may further include a plurality of mounting holes 130 for receiving fasteners such as screws to fixedly mount the leaves to the hinged objects in a conventional manner.

It will be appreciated that pinned hinge 10 is expressly not limited for use in door installations alone, but may be used in any type of application where at least two hinged objects are to be pivotally connected.

Figure 5:
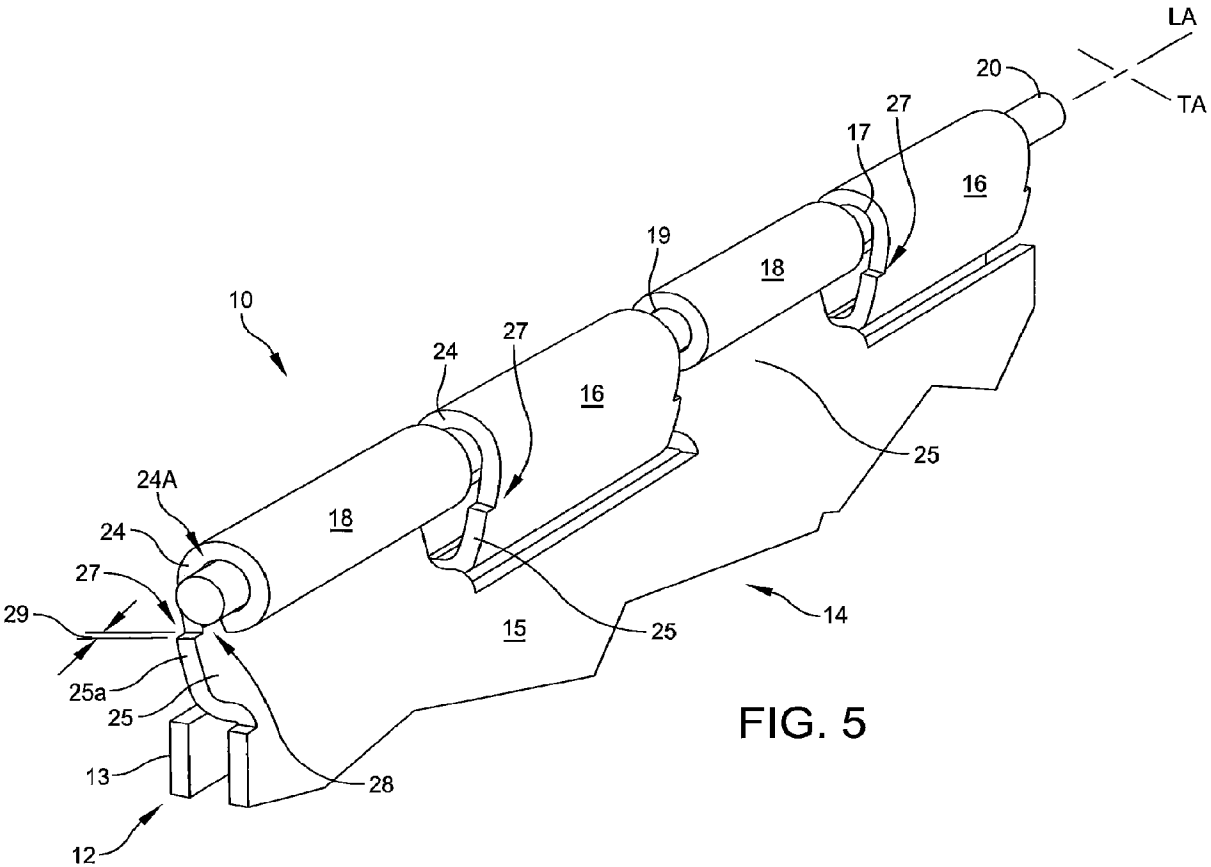
FIG. 5 is a perspective view of a portion of the hinge of FIG. 1 showing only the hinge members and joining pin.

Referring to FIGS. 1 and 5, knuckles 16, 18 have axial passageways 17, 19 which extend longitudinally through the knuckles and define longitudinal axis LA of pinned hinge 10. Transverse axis TA is defined across and perpendicular to longitudinal axis LA as shown and further described herein. Knuckle passageways 17, 19 are configured and dimensioned to receive pin 20 therethrough that pivotally connects hinge members 12 and 14 together for conventional angular movement with respect to each other. Preferably, the passageways 17, 19 are substantially circular in cross section to receive pin 20 which is also preferably circular in cross section. It will be appreciated by those skilled in the art that the passageways 17, 19 need not be perfectly circular in cross section, but preferably should be sized and configured to closely correspond to the diameter of pin 20 to prevent excess transverse or lateral play in the passageways so that hinge 10 functions smoothly and properly. Preferably, the passageways 17, 19 of each knuckle 16, 18 are substantially coaxially aligned with the passageways of other knuckles of the same hinge member. The hinge members 12, 14 are cooperatively sized and configured such that the passageways 17, 19 of each hinge member fall into axial alignment when hinge 10 is assembled with the pin 20 inserted therein.

Figure 6:
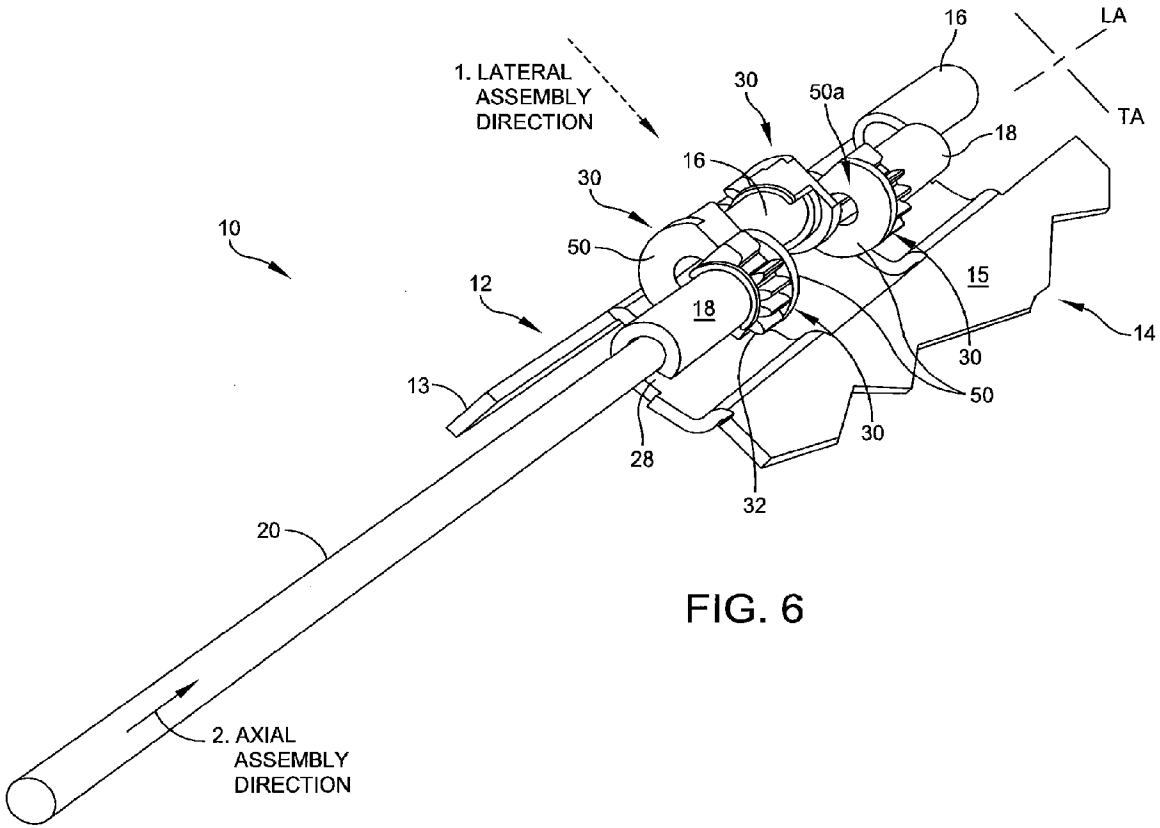
FIG. 6 is a perspective view of a portion of the hinge of FIG. 1 in a pre-assembled condition.

Referring to FIGS. 5 and 17A-C, knuckles 16, 18 are each coupled to leaves 13, 15 respectively by relatively straight shank 25 that extends longitudinally along a portion of inner lateral side 22 (see FIG. 1). The longitudinally extending sides of shank 25 where the shank transitions into the leaf preferably includes a double bend comprised of two opposing bends 26 oriented in opposite directions (see, e.g. FIG. 13). The double bend laterally offsets each leaf 13, 15 from the shank 25 as shown in FIG. 6 to prevent interference between the cover adapter clip 70 and cover 60 when the hinge 10 is opened and closed. Cover 60 becomes partially nested or recessed between the knuckles and leaves when the hinge 10 is in a fully open position with the leaves 180 degrees spread apart.

Preferably, each hinge member 12, 14 may be formed from a single monolithic piece of material which is formed and machined to define the knuckles, leaves and shank portion thereby providing a strong hinge that can be produced in a minimal number of fabrication steps.

The hinge members 12, 14 and pin 20 may be manufactured from a variety of different materials including, but not limited to brass, steel, aluminum, titanium, plastics, composites, etc. The hinge members 12, 14 with appurtenances such as knuckles 16, 18 and pin 20 may be manufactured by any suitable conventional techniques known in the art such as, but not limited to roll forming, stamping, embossing, extruding, casting, molding, etc. The selection of materials and manufacturing techniques are well within the purview of those of ordinary skill in the art to select and will not be expounded upon herein in detail.

According to aspects of the present invention, a vertical load bearing system and articulating cover system are provided for hinge 10.

Figure 3A:
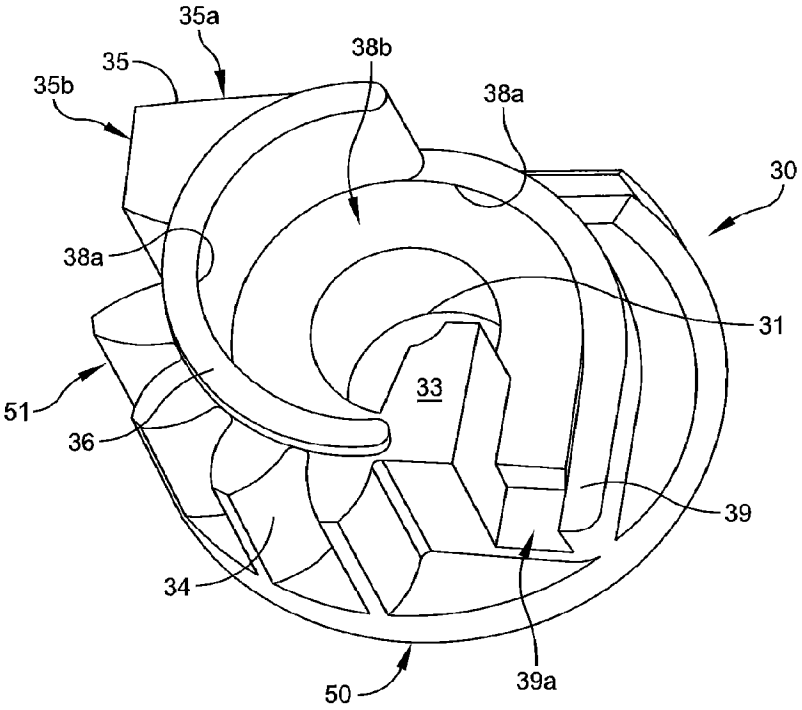
FIGS. 3A-3G show various perspective views of one embodiment of a geared bearing insert useable in the hinge of FIG. 1.
Figure 3B:
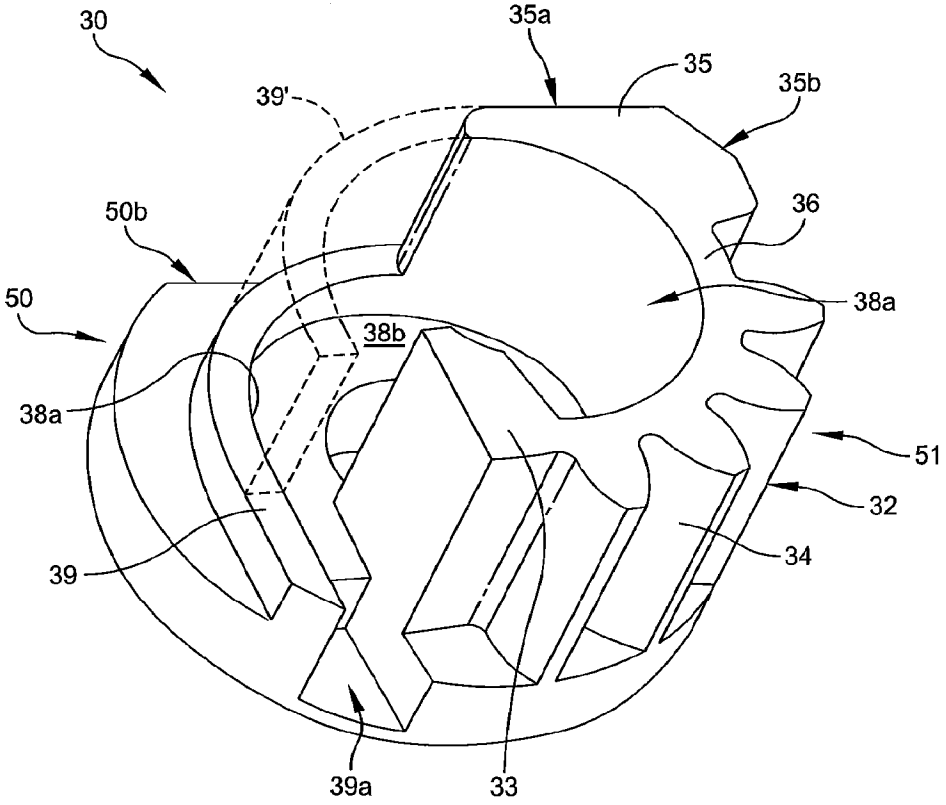
Figure 3C:
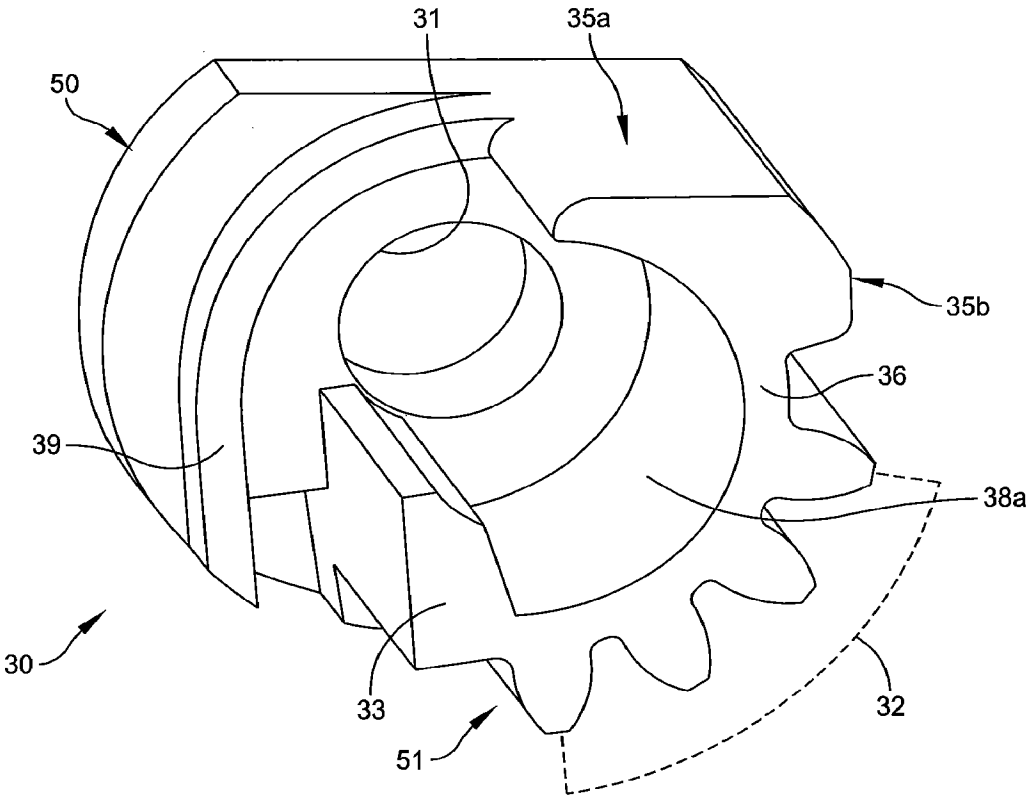
Figure 3D:
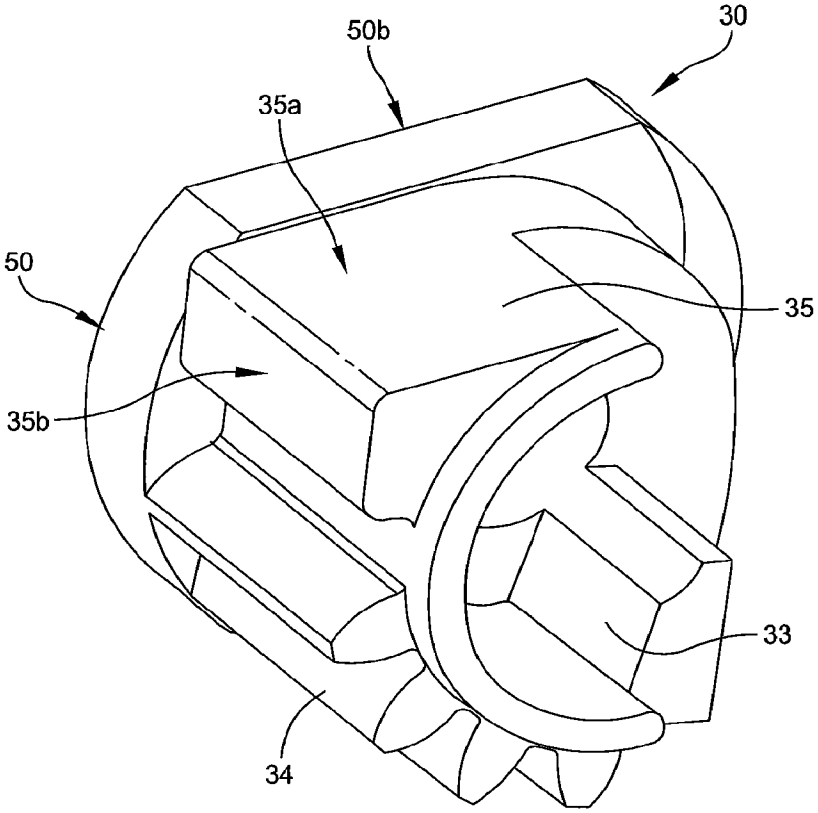
Figure 3E:
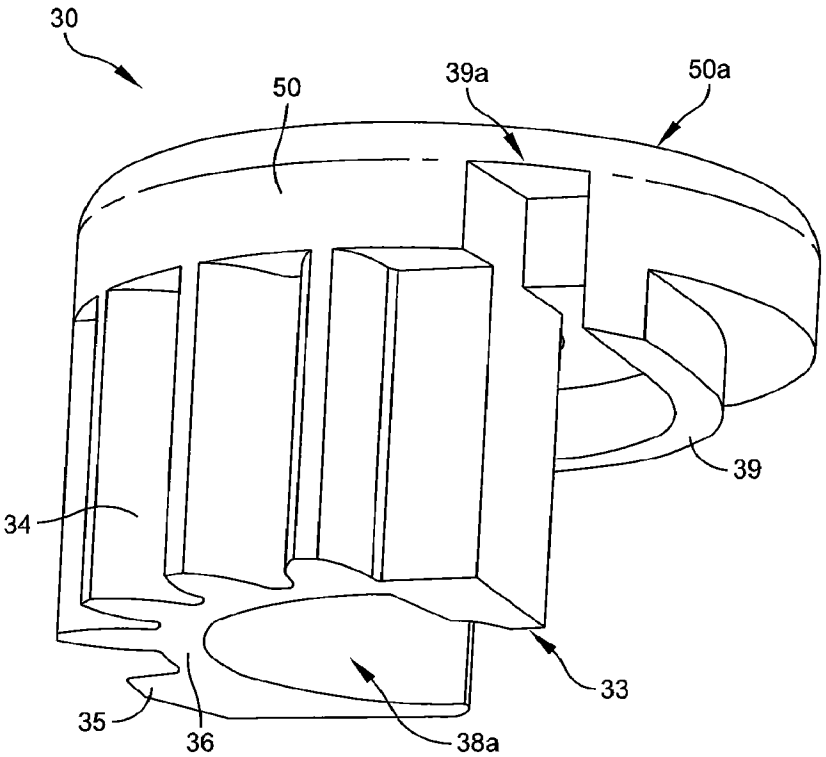
Figure 3F:
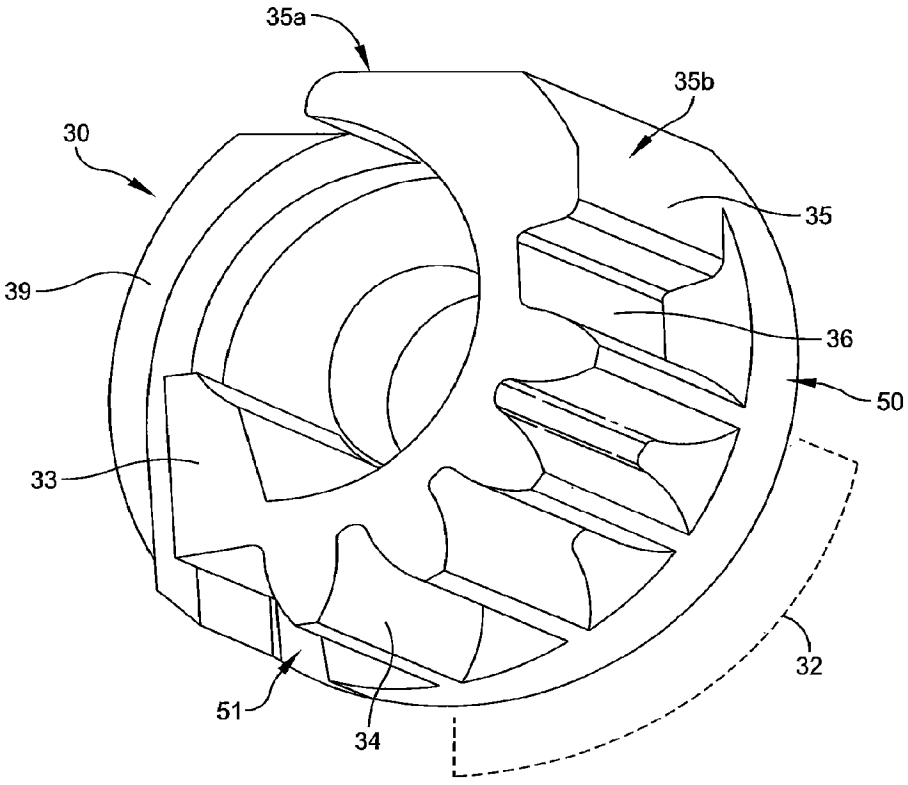
Figure 3G:
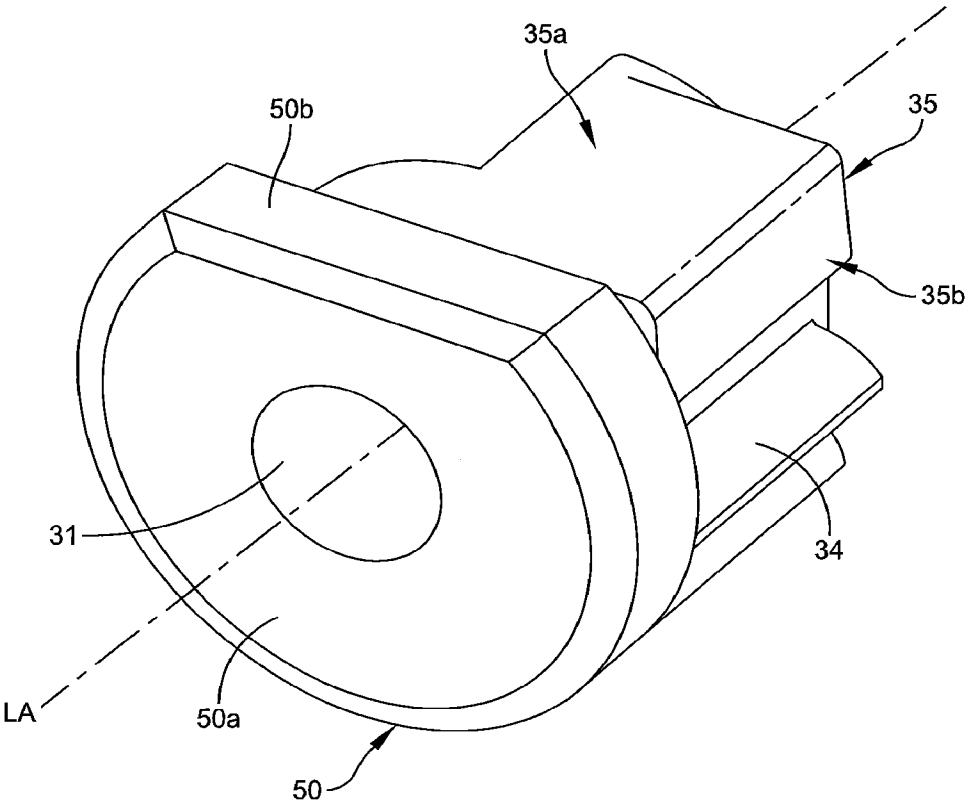
Figure 4A:
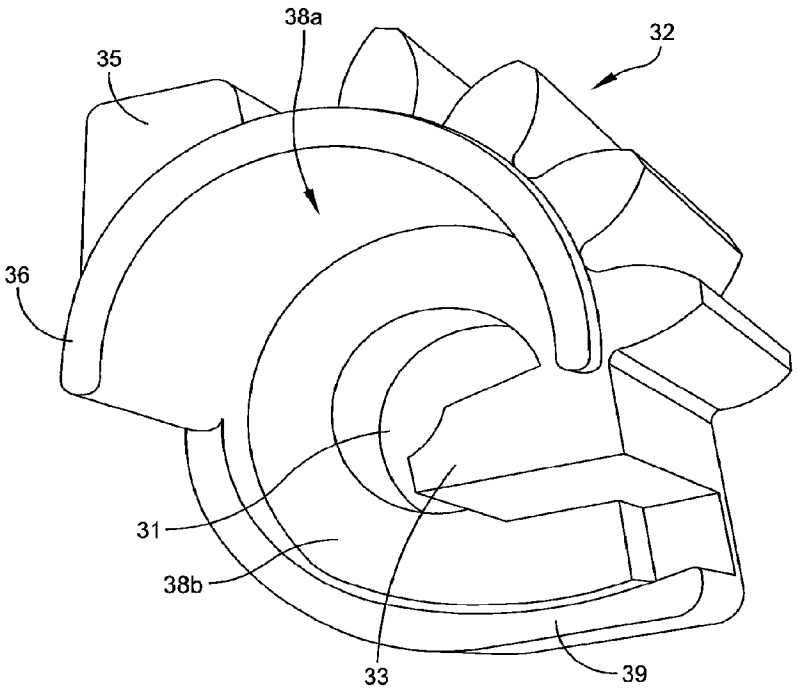
FIGS. 4A-4C show various perspective views of a second embodiment of a geared bearing insert useable in the hinge of FIG. 1.
Figure 4B:
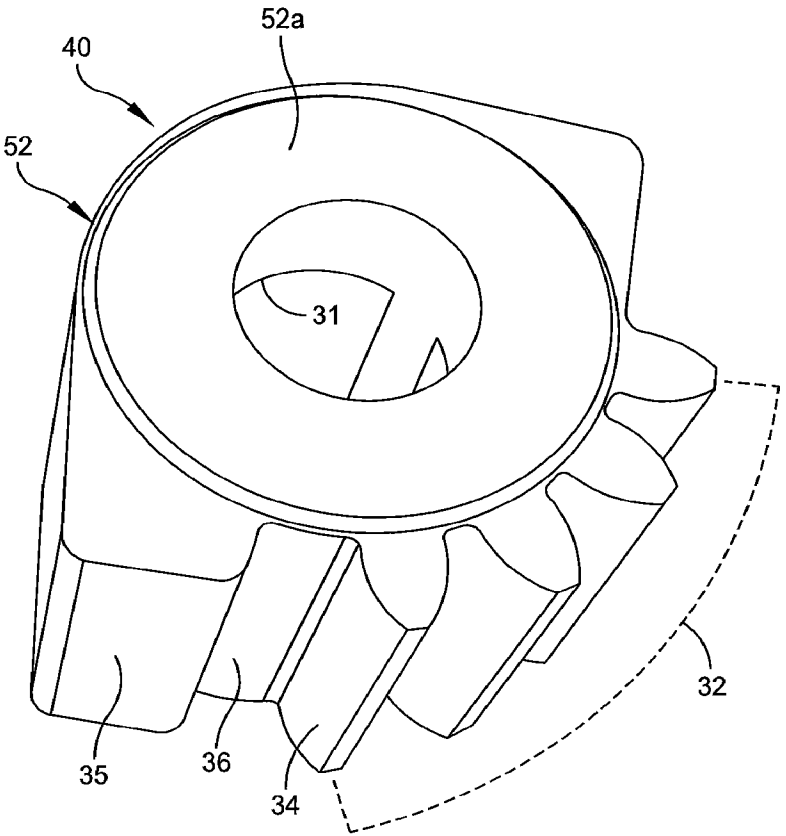
Figure 4C:
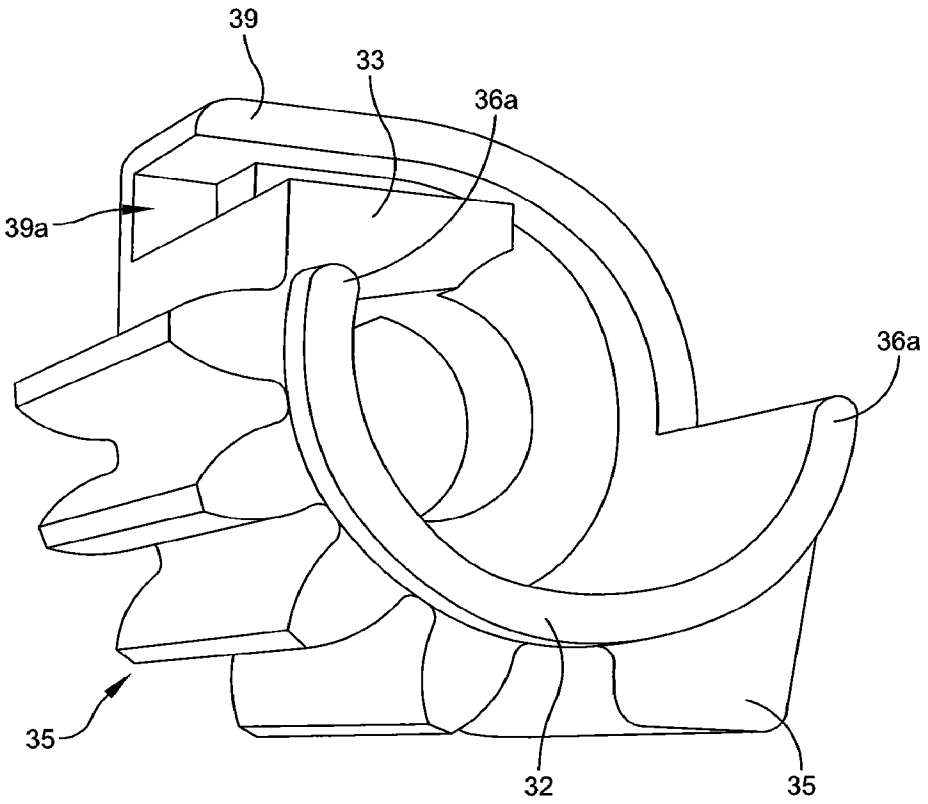

As shown in FIG. 1, hinge 10 may further include one or more geared bearing inserts 30 or 40 which may be interspersed and mounted between adjacent pairs of knuckles 16, 18 as further described herein. FIG. 2 shows a partial exploded perspective view of hinge 10 with geared bearing inserts 30 and knuckles 16, 18. FIGS. 3A-G shows multiple perspective views of a heavy duty geared bearing insert 30. FIGS. 4A-C shows multiple perspective views of a standard duty geared bearing insert 40. Hinge 10 will be further described presently for convenience with reference to geared bearing inserts 30; however, the discussion generally applies to geared bearing insert 40 as well except where noted and distinguished.

Referring now to FIGS. 1-3, at least one, but preferably two geared bearing inserts 30 may be mounted to hinge members 12 and 14 between each pair of adjacent knuckles 16, 18. Geared bearing inserts 30 may be mounted onto opposing ends 24 of adjacent knuckles 16, 18 in a preferred embodiment as shown in FIG. 2. Geared bearing inserts 30 each may be described as having a somewhat overall cylindrical shape with a variety of functional appurtenances and openings as further described herein.

Forming an operable part of the hinge vertical load bearing system, each geared bearing insert 30 includes an integral bearing portion 50 defining a planar annular bearing surface 50*a* thereon and a geared portion 51 for articulating the hinge cover system, as shown in FIGS. 2 and 3. Bearing portion 50 may be generally shaped like a disk having a circular configuration that complements the generally circular configuration of cylindrical knuckles 16, 18. Bearing portion 50 may therefore be shaped similarly to a flat washer with a central aperture 31. In some embodiments, the geared bearing inserts may have a full circular shape (see, e.g. FIG. 4A-C) or a partially circular shape (FIGS. 3A-G), as further described herein.

Forming an operable part of the articulating hinge cover system, each geared bearing insert 30 preferably includes an arcuately shaped partial wall 36 (hereafter "arcuate wall") extending axially from and circumferentially with respect to bearing portion 50, as shown in FIGS. 3A-G. Arcuate wall 36 includes an arcuate shaped gear tooth segment or sector 32 disposed on an outer surface thereof and comprised of a plurality of gear teeth 34 projecting radially outwards for mechanically articulating and moving cover adapter clip 70 with attached cover 60 in relation to hinge knuckles 16, 18 and pin 20, as further described herein. Accordingly, gear teeth 34 are cooperatively designed and sized to mate with the teeth 81 of gear racks 71 formed on cover adapter clip 70 (see, e.g. FIGS. 8 and 9). An inner surface 38*a* of arcuate wall 36 defines an arcuately shaped seat for receiving and engaging a portion of knuckles 16, 18 when the geared bearing inserts 30 are mounted on the knuckles. Arcuate wall 36 preferably has an axial length sufficient to at least partially engage the ends 24 of knuckles 16, 18 and to accommodate gear teeth 34. Gear teeth 34 preferably extend longitudinally or axially a sufficient length to be substantially coextensive with the axial length of cooperatively meshing gear rack 71 including gear teeth 81 disposed on cover adapter clip 70 (see, e.g. FIG. 8), further described herein.

In a preferred embodiment, arcuate wall 36 is semi-cylindrical in shape wrapping partially around the circumference of the cylindrical knuckle 16, 18 to which it is mated. Arcuate wall 36 further has an axial length sufficient to provide secure mounting of the geared bearing insert 30 to the knuckle 16, 18 so that geared bearing insert 30 remains stably positioned during opening and closing of hinge 10. Arcuate wall 36 may extend circumferentially through an angle of about 180 degrees on geared bearing insert 30 in some embodiments, thereby forming a half cylindrically shaped wall as shown in FIGS. 3A-G. Gear tooth sector 32 is disposed circumferentially on a sector of the arcuate wall 36. In a preferred embodiment, gear tooth sector 32 may cover about a quadrant or one-fourth (i.e., on an arc of about 90 degrees) along the circumference of arcuate wall 36. In other embodiments, the gear tooth sector 32 may comprise more or less than one-fourth of the outer circumference of arcuate wall 36 so long as the cover 60 and cover adapter clip 70 may be properly articulated through a full range of angular motion without binding.

With continuing reference to FIGS. 1-3, central aperture 31 of geared bearing insert 30 is preferably configured and dimensioned to allow pin 20 to pass completely therethrough for interconnecting all knuckles 16, 18 and geared bearing inserts in hinge 10.

To prevent geared bearing inserts 30 from over-rotating with respect to knuckles 16, 18 when pivoted towards a fully open and flat position, and also maintain engagement between at least some of the teeth 34 and gear rack 75 of cover adapter clip 70 (see, e.g. FIG. 8), the geared bearing inserts in some embodiments includes a robust motion-limiting stop 35. In one embodiment, motion-limiting stop 35 may be configured as a robust essentially axially extending cantilevered lug that protrudes outwards in a generally radial direction from arcuate wall 36 as shown in FIGS. 3A-G. Stop 35 is offset from the centerline of insert 30 defined by central aperture 31. In the embodiment shown, stop 35 includes a generally radially oriented flat top stopping surface 35*a* facing in a first essentially radial direction that terminates at a first one of the radial edges 36*a* of arcuate wall 36 and an adjoining generally radially oriented flat side stopping surface 35*b* facing in a second essentially radial direction. In one embodiment, the first radial direction is approximately 90 degrees apart angularly from the second radial direction. As shown in FIGS. 3A-G, motion-limiting stop 35 may be disposed on a portion of arcuate wall 36 unoccupied by gear teeth 34 and at the first radial edge 36*a* opposite the opposing remaining second radial edge 36*a*.

Figure 17A:
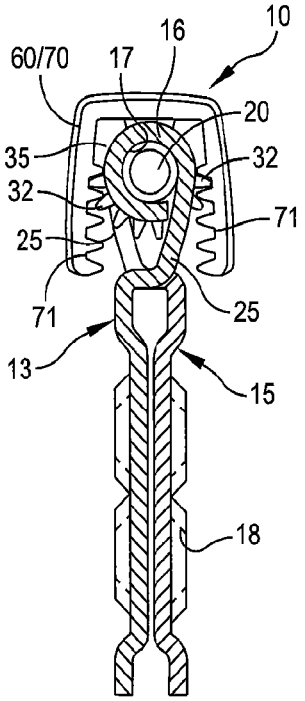
FIGS. 17A-17C show sequential operating steps of the hinge of FIG. 1 from a closed position to an open position.

Top stopping surface 35*a* is preferably oriented to intersect a portion of arcuate wall 36 adjacent the first radial edge 36*a* at a tangent so that the stop does not project outwards farther than arcuate wall 36 at radial edge 36*a*. This arrangement beneficially reduces the projecting dimension of motion-limiting stop 35 radially to minimize the lateral/transverse height of the cover adapter clip 70 and cover 60. This arrangement also advantageously functions to prevent interference between motion-limiting stop 35 and the cover adapter clip 70 when hinge 10 is in a fully closed position as shown in FIG. 17A.

Figure 17B:
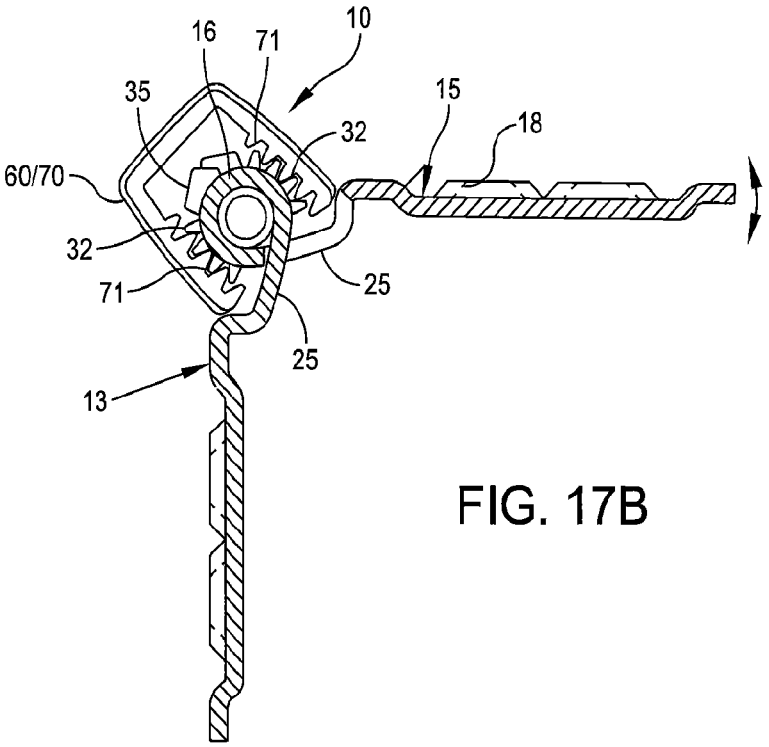
Figure 17C:
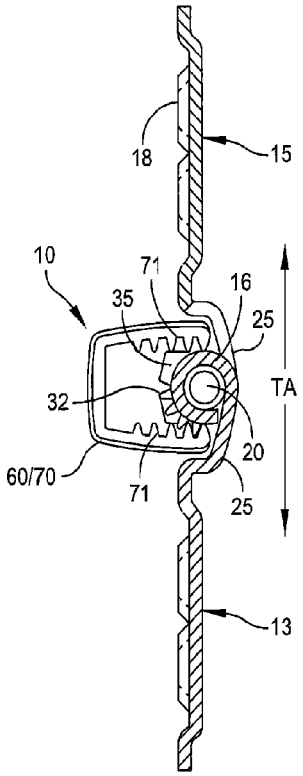

Motion-limiting stop 35 advantageously provides a robust, solid area that (1) prevents cover adapter clip 70 from being pushed too far onto geared bearing inserts 30 (see, e.g. FIG. 14) during hinge assembly by engaging the top 80 of the adapter clip, (2) supports preferably roll formed cover 60 under lateral or side impact loads to resist permanent deformation or denting, (3) provides additional end wise bearing surface support (axially) within the cover adapter clip by engaging surface 77*a* (see FIG. 8) of the adapter clip to resist the adapter clip moving longitudinally along the knuckles, (4) prevents improper indexing of the adapter clip to the gear insert teeth by allowing both sides of the adapter clip to firmly seat against stop(s) 35 of each of the geared bearing inserts 30, and (5) assists in meshing the gear rack 71 portions of the adapter clip 70 to the geared teeth of the inserts during assembly to ensure their correct angular positioning and thereby the correct angular positioning of the leaves. As shown in FIG. 17C, the motion-limiting stop 35 further beneficially functions to engage gear racks 71 to resist over-opening of hinge 10 to the point where gear sectors 32 may unintentionally become disengaged from gear racks 71 in some instances. To maximize the structural and functional effectiveness and size of stop 35, the stop preferably extends longitudinally for substantially the entire axial length of arcuate wall 36 and may have an angular thickness (measured circumferentially) that is larger than the angular thickness of gear teeth 34 (best shown in FIGS. 3A-G). In some embodiments, as shown in FIGS. 3B and 3D, a portion of stopping surface 35*b* adjoining stopping surface 35*a* may be chamfered to avoid interference and binding with gear racks 71 inside cover adapter clips 70 or 90. In other embodiments, as shown in FIGS. 3A and 4A, stopping surfaces 35*a* and 35*b* may intersect each other with an essentially square (i.e. 90 degree) or slightly radiused edge. Either arrangement is satisfactory depending on the clearances afforded by the cover adapter clip.

At the second radial edge 36*a* of arcuate wall 36, a geared bearing insert-to-knuckle locking mechanism may be provided in form of a locking protrusion such as a radially-extending anti-rotation tab 33 (see FIGS. 3A-G) that engages a complementary configured receptacle in hinge members 12, 14. In one embodiment, tab 33 is configured and dimensioned for slidable insertion into and engagement with a portion of a complementary configured and dimensioned longitudinally-extending slot 28 formed in each hinge member 12, 14. Slot 28 is generally formed between each knuckle 16, 18 and respective shank 25 during fabrication of the hinge members (see also FIGS. 2 and 6). Slot 28 may extend longitudinally for the majority or entire axial length of each knuckle 16, 18. Tab 33 preferably extends longitudinally for substantially the entire axial length of arcuate wall 36 in some embodiments. Anti-rotation tab 33 prevents relative rotation between geared bearing insert 30 with respect to knuckles 16, 18 to which the inserts are mounted.

Referring to FIGS. 2, 3, and 6, tab 33 is cantilevered from arcuate wall 36 and protrudes radially inwards towards the center of geared bearing insert 30. Tab 33 is used to mount geared bearing insert 30 to knuckles 16, 18 and prevents rotation of the insert 30 with respect to the knuckle.

Referring to FIGS. 3A-G, geared bearing insert 30 may further include a second arcuate partial wall such as flanged ridge wall 39 (hereafter "ridge wall"). Ridge wall 39 originates at the radial edge 36*a* of arcuate wall 36 (proximate motion-limiting stop 35) having an initial arcuately shaped portion and then extends circumferentially towards tab 33 terminating with a substantially straight portion to conform to a corresponding straight portion on knuckles 16, 18 adjacent shank 25 of each hinge member 12, 14. When geared bearing insert 30 is mounted on a knuckle, ridge wall 39 extends partially over the ends 24 of the knuckle (see, e.g. FIG. 1), thereby receiving a portion of each knuckle end 24 partially into geared bearing insert 30 to add more stability to the mounting than otherwise possible.

Figure 7:
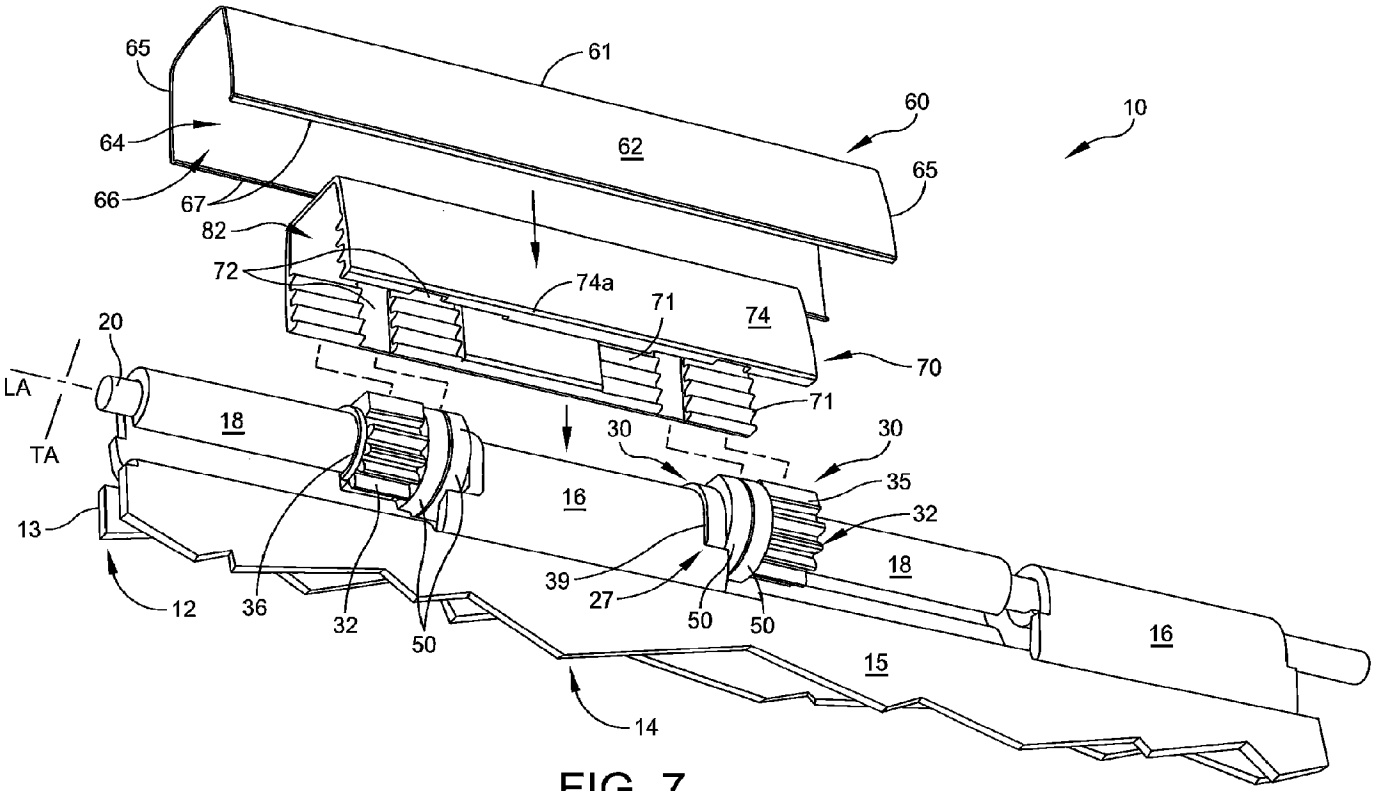
FIG. 7 is a perspective view of the hinge of FIG. 1 with a mechanically articulated hinge cover system shown in exploded pre-assembled view.

Ridge wall 39 in combination with arcuate wall 36 of geared bearing insert 30 collectively form a partial cylindrical collar or end cap as shown in FIGS. 3A-G that extends axially from bearing portion 50 and at least covers partially knuckle ends 24 as shown in FIGS. 1 and 7. Ridge wall 39 and arcuate wall 36 collectively define both a circumferentially extending inner wall surface 36*a* and annular surface 39*b* between these walls 39 and 36. Ends 24 of knuckles 16, 18 abuttingly engage annular surface 39*b* and the knuckles laterally engage wall surface 36*a* when geared bearing insert 30 is mounted onto the knuckles. Ridge wall 39 further assists with positioning and locating geared bearing insert 30 on knuckles 16, 18 prior to insertion of pin 20 into the hinge 10 assembly. that slips over the ends 24 of knuckles 16, 18 and a generally annular surface 39*b*

As shown in FIGS. 3A-G, ridge wall 39 may have a substantially shorter axial height or length than arcuate wall 36 for aesthetic purposes to reduce the amount of geared bearing insert 30 that is visible on knuckles 16, 18 from the underside viewing aspect when hinge 10 is in an open position as shown in FIG. 1. In other embodiments contemplated (shown in dashed lines in FIG. 3B), a ridge wall 39' may optionally have the same height or axial length as arcuate wall 36 when it may be desirable to more completely cover knuckles 16, 18 and provide additional stability to the mounting of geared bearing inserts 30 to the knuckles.

In some embodiments, as shown in FIGS. 2, 3, and 5, the ends 24 of knuckles 16, 18 may contain a stepped portion 27 formed on the ends 24 of each knuckle to allow each geared bearing insert 30 to sit more flushly with the ends 24 of each knuckle. This creates an axial offset 29 between the knuckles 16, 18 and respective shank 25 of each knuckle (see, e.g. FIG. 5). FIG. 5 shows hinge 10 assembled without geared bearing inserts 30 in place to more clearly show the knuckle arrangement. Stepped portion 27 may begin on each knuckle 16, 18 approximately where shank 25 joins the knuckle. In a preferred embodiment, shanks 25 therefore have a longer axial length than their respective adjoining knuckle 16, 18. This arrangement allows for an axially thicker bearing portion 50 on geared bearing insert 30 while minimizing the overall axial length needed for geared bearing insert 30 because less of each geared bearing insert projects beyond the ends 25*a* of each adjoining shank 25. The additional thickness of the bearing portion 50 provides for a more robust, cushioned and longer wearing bearing surface 50*a* which translates into a longer service life for hinge 10 before any bearing inserts 30 may require replacement.

Geared bearing insert 30 further may include a pocket defined by stepped portion 39*a* formed in annular surface 38*b* between locking tab 33 and the free end of ridge wall 39 as shown in FIGS. 3A-G. Stepped portion 39*a* mates with stepped portion 27 of knuckles 16, 18 so that the axially longer portion shank 25 adjacent knuckle ends 24 may be partially received in the space between ridge wall 39 and locking tab 33 so that ridge wall partially extends onto the shank for added stability (see, e.g. FIGS. 1 and 7). Stepped portion 39*a* further minimizes the axial length of each geared bearing insert 30. In addition, as further described herein, the stepped portion 39*a* of geared bearing inserts 30 minimizes the axial drop that may occur during a fire in the event the geared bearing inserts 30 were to melt.

In cases where hinge 10 may be used to install a fire rated door, stepped portion 27 of knuckles 16, 18 (see FIGS. 1 and 5) further provides a significant fire code compliance function via a pair of opposing partial annular surfaces 24*a* defined by the ends 24 of each knuckle 16, 18. The fire rated door cannot drop more than the offset 29 (see FIG. 5) between the knuckles 16, 18 in the event a fire were to melt geared bearing inserts 30 that in some embodiments may be made of polymer or similarly less heat resistant material than some metals. When the fire rated door is in the closed position within a conventional door frame as will be readily known to those skilled in the art without illustration, the resulting gap left between the top of the door and top door frame header when the geared bearing inserts 30 melt away during a fire event is thereby minimized by the stepped portion 27 of the knuckles. If the geared bearing inserts 30 begin to melt, then end surfaces 25*a* on opposing shanks 25 would come into contact with each as the door drops without the geared bearing inserts 30 present to provide support between adjacent knuckles. It should be noted that in some fire rated door applications, geared bearing inserts 30 may optionally be made of metal such as without limitation titanium, aluminum, or steel for example to provide greater heat resistance.

Referring to FIGS. 3 and 4, heavy duty geared bearing inserts 30 have an annular bearing portion 50 with a diametrically larger effective bearing surface 50*a* than annular bearing surface 52*a* on bearing portion 52 of standard duty geared bearing insert 40. This creates a larger total bearing surface area on geared bearing insert 30 than geared bearing inserts 40. Geared bearing inserts 30 therefore have the ability to support larger door loads and weights than geared bearing inserts 40. In all other respects, geared bearing inserts 40 are configured essentially the same as geared bearing inserts 30 and have the same appurtenances, features, and functionality as already described herein (see, e.g. FIGS. 3A-G). Whereas bearing portion 52 on geared bearing insert 40 may have a completely circular shape, bearing portion 50 on geared bearing insert 30 may have a flat side or lateral surface 50*b* as shown in FIGS. 3A-G to avoid rotational interference with cover adapter clip 70. This arrangement beneficially also reduces the projecting dimension of bearing portion 50 radially to minimize the lateral/transverse height of the cover adapter clip 70 and cover 60. Flat lateral surface 50*b* is disposed adjacent stop 35 as shown in FIGS. 3A-G and would be rotatably positioned inside cover adapter clip 70 when hinge 10 is fully assembled.

In one embodiment, heavy duty geared bearing insert 30 may have a bearing portion 50 with a maximum outer diameter at least approximately equal to the tip diameter of the gear teeth 34 of gear sector 32, as shown in FIGS. 3A-G. In some alternate embodiments (not shown), the outer diameter of bearing portion 50 may be larger than tip diameter of gear teeth 34 where it is desired to provide a greater bearing surface 50*a*. Preferably, bearing portions 50 have an outer diameter larger than the diameter defined by knuckles 16, 18.

By contrast, standard duty geared bearing inserts 40 may have a maximum outer diameter approximately equal to the root diameter of gear teeth 34 of gear sector 32, as shown in FIGS. 4A-C. Accordingly, bearing surface 50*a* of geared bearing insert 30 has a large effective bearing diameter than bearing surface 52*a* of geared bearing insert 40.

It should be noted that the terms "heavy duty" and "standard duty" in reference to geared bearing inserts 30 and 40 is for convenience only in describing the relative load bearing potential of each insert, and therefore is expressly not a term of limitation on the invention.

Advantageously, geared bearing inserts 30 and 40 function to provide a combination of both improved vertical load bearing capacity between adjacent knuckles that result in smooth operation and support of a hinged object such as a door, in addition to providing a means for articulating cover adapter clip 60 and attached cover 70 to be further described herein.

FIG. 7 shows hinge 10 with the knuckles 16, 18 of hinge members 12 and 14 joined pivotably connected together by pin 20 longitudinally-extending through the knuckles. Geared bearing inserts 30 are positioned in place between adjacent pairs of knuckles 16, 18 with the bearing portion 50 of each geared bearing insert being in axially abutting contact or engagement. The vertical load bearing system of hinge 10 is therefore fully assembled and operable as shown in FIG. 7.

The articulating cover system of hinge 10 operated via geared bearing inserts 30 and cover adapter clip 70 will now be further described.

Articulating Cover System

Figure 8:
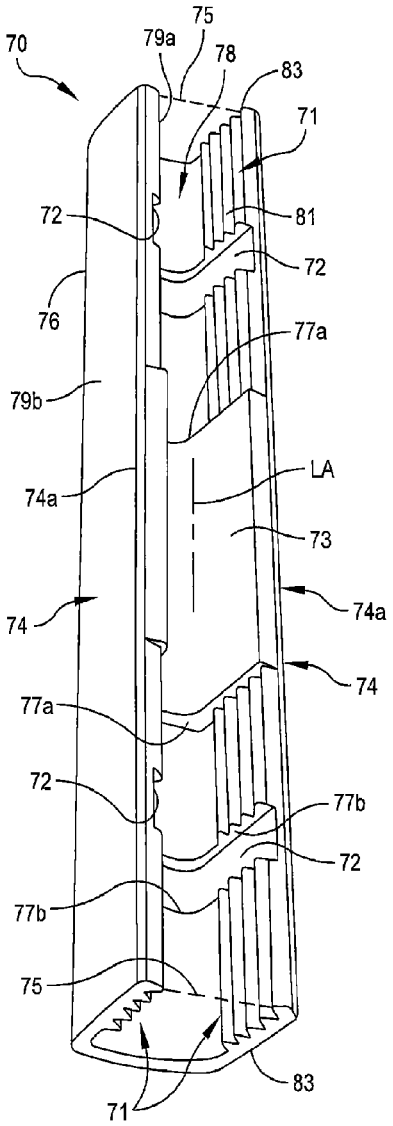
FIG. 8 is a perspective view of a cover adapter clip useable with the hinge of FIG. 1 and geared bearing inserts of FIG. 3.
Figure 12:
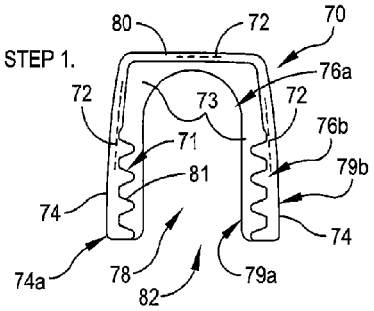
FIGS. 12-16 show sequential assembly steps of an inner cover adapter clip and outer cover of the hinge of FIG. 1.

The articulating cover system includes an inner cover adapter clip 70 and outer cover 60 which mounts onto the clip. Cover adapter clip 70 comprises the operating component of the hinge cover system that operably interacts, cooperates with, and mechanically couples geared bearing inserts 30 to articulate the cover 60. FIG. 8 shows one embodiment of a cover adapter clip 70 for use with geared bearing inserts 30. FIG. 12 shows an end view of cover adapter clip 70.

Referring now to FIGS. 7, 8 and 12, cover adapter clip 70 includes an elongated substantially hollow body 76 defining an inner surface 79*a* and an outer surface 79*b*. Cover 60 further includes a roof or top 80, two opposing lateral sidewalls 74 which may be in general parallel relationship in some embodiments, and an open bottom 82. Sidewalls 74 further define a pair of longitudinally-extending edges 74*a*. A longitudinally-extending open channel 78 extends through the cover adapter clip 70 from end 83 to opposite end 83. Cover adapter clip 70 further includes a generally plain upper interior portion 76*a* and a geared lower interior portion 76*b* (see, FIG. 12).

Open bottom 82 imparts lateral flexibility and allows the cover adapter clip 70 to be transversely and slidably slipped over the knuckles 16, 18 and geared bearing inserts 30 previously assembled onto hinge 10. In some embodiments where hinge 10 may be an axially short butt hinge, an end cap or closure 75 (shown in dashed lines in FIG. 8) may optionally be provided on one or preferably each end 83 to enclose and protect the end hinge knuckles 16, 18 of the hinge and provide an aesthetically pleasing appearance.

With continuing reference to FIGS. 7, 8 and 12, cover adapter clip 70 further includes opposing banks of longitudinally-extending gear teeth 71 that are preferably arranged on inner surface 79*a* of lower interior portion 76*b* along sidewalls 74 to form gear racks 71. During operation of hinge 10, gear racks 71 mesh and cooperate with complementary configured gear sectors 32 on geared bearing insert 30 to articulate cover adapter clip 70 with cover 60. Gear sectors 32 travel up and down transverse to longitudinal axis LA along the gear racks 71 as hinge 10 is opened and closed, as shown in FIGS. 17A-17C. At least one gear rack 71 is provided for each gear sector 32.

Referring to FIGS. 8 and 12, cover adapter clip 70 further includes at least one transversely oriented bearing locking groove 72 that is formed in the lateral sidewalls 74 and top 80 of cover adapter clip 70. Groove 72 is recessed into body 76 of cover adapter clip 70 and may form a generally U-shaped groove in some embodiments as shown. Groove 72 is configured and dimensioned to receive at least partially therein the bearing portions 50 (see, e.g. FIGS. 3 and 6) of geared bearing inserts 30. Preferably, groove 72 has an axial length that is sufficient to receive a mutually engaged pair of bearing portions 50 therein from abutting geared bearing inserts 30 mounted on opposing ends 24 of two knuckles 16, 18 (i.e. back-to-back bearing portions 50 from two geared bearing inserts). Advantageously, groove 72 allows diametrically larger bearing portions 50 to be provided while keeping the profile of cover adapter clip 70 as slim as possible.

Bearing locking groove 72 further operably assists with maintaining the cover adapter clip in a fixed axial longitudinal position along the longitudinal axis LA with respect to hinge 10 and knuckles 16, 18 so that the clip cannot slide up and down longitudinally along the hinge. This may be accomplished by a transversely oriented U-shaped end stop surface 77*b* at each axial end of the groove 72. End stop surface 77*b* abutting and slidably engages bearing portions 50 of geared bearing inserts 30 (see FIGS. 3A-G) to assist with keeping cover adapter clip 70 centered over the center hinge knuckle between pairs of geared bearing inserts 30.

Cover adapter clip 70 preferably further includes a raised central saddle or stop portion 73 that extends above and inwards from body 76, as shown in FIGS. 8 and 12. Stop portion 73 is configured and dimensioned to slide and fit loosely over that portion of the hinge knuckle 16 or 18 that is disposed between pairs of geared bearing inserts 30, such as shown in FIG. 7. This assists with maintaining the adapter clip 70 centered on knuckles 16, 18. In the embodiment shown in FIGS. 8 and 12, stop portion 73 may be generally U-shaped and protrudes inwards towards channel 78 from the lateral sidewalls 74 and top 80 of cover adapter clip 70 wherein the stop portion is continued over the top 80 of the adapter clip. Stop portion 73 defines an essentially transversely oriented U-shaped end stop surface 77*a* at each axial end of the stop portion. Stop surface 77*a* abutting and slidably engages geared bearing inserts 30 at the free end of arcuate wall 36 (see FIGS. 3A-G) to assist with keeping cover adapter clip 70 centered over the center hinge knuckle between pairs of geared bearing inserts 30.

As shown in FIGS. 8 and 12, cover adapter clip 70 in some preferred embodiments may include two locking grooves 72 with one groove being disposed and spaced apart from each end stop surface 77*a* of central stop portion 73. Cover adapter clip 70 is longitudinally short and in the embodiment shown has an axial length which covers both pairs of geared bearing inserts 30 at each opposite end of the central knuckle 18 (see, e.g. FIGS. 1 and 7) and the central knuckle. This embodiment provides symmetrical support of the central knuckle 18 to each adjacent knuckle 16 by covering both pairs of geared bearing inserts 30 on either side of the central knuckle. This symmetrical design advantageously helps to better resist twisting forces on the hinge 10 to keep the knuckles 16, 18 concentrically aligned and provide for smooth operation of the hinge.

Figure 9:
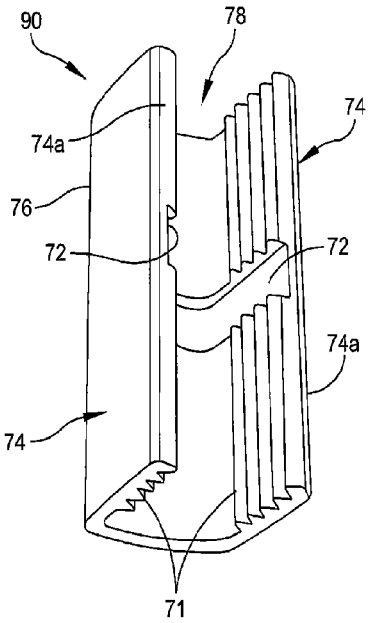
FIG. 9 is a perspective view of an alternative embodiment of a cover adapter clip useable with the hinge of FIG. 1 and geared bearing inserts of FIG. 3.

FIG. 9 shows an alternative cover adapter clip 90 formed from a portion of cover adapter clip 70 for heavy duty geared bearing inserts 30. Cover adapter clip 90 includes a single bearing locking groove 73 with a gear rack 71 disposed on either axial end thereof. This design is longitudinally shorter than adapter clip 70 (shown in FIG. 10) and covers a single joint between adjacent knuckles 16, 18 and a single pair of geared bearing inserts 30. The cover adapter clip 90 is longitudinally retained in position by bearing locking groove 90, but it lacks the symmetrical positioning fixation along axis LA afforded by adapter clip 70 because adapter clip 90 meshes with gear teeth disposed longitudinally on opposite side of the pair. Therefore, it requires two or more such clips to be mounted on a hinge which may then be maintained in alignment on the hinge axis by the cover itself. However, the advantages of the smaller part size of FIG. 9 as opposed to FIG. 8 with respect to mold simplicity and the smaller size and cost of the part may be advantageous in production, especially if the total number of adapter clips required to achieve proper support and stiffness of certain types of cover materials is high because of the reduced spacing required.

Figure 20:
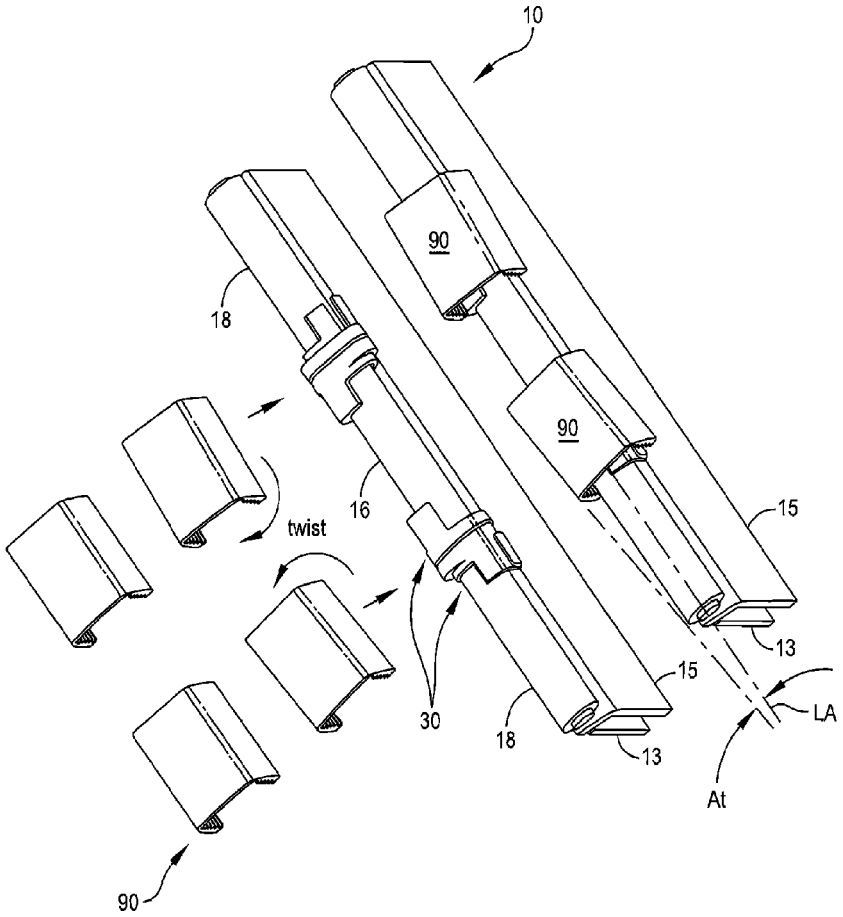
FIG. 20 shows an installation sequence of the adapter clip of FIG. 9.

FIG. 20 shows adapter clips 90 during the installation process on hinge 10. Short adapter clip 90 have a tendency to twist a bit with respect to the longitudinal axis LA and knuckles 16, 18 when they are installed because the gears 32 on the geared bearing inserts 30 are diametrically oriented, but are straightened out as soon as the cover 60 is installed. In addition, the short adapter clip 90 covers only a single pair of geared bearing inserts and knuckles in contrast to clips 70 (see, e.g. FIG. 7) giving clips 90 the ability to angularly twist to a certain extent. Because of the twisting action, adapter clips 90 advantageously facilitate putting cover 60 thereon due to their angular displacement capabilities in contrast to adapter clip 70, and clips 90 are furthermore less expensive to manufacture. In one embodiment, adapter clips 70 may have an angular displacement represented by angle At of approximately 5 degrees. Preferably, adapter clips 70 are provided at closer spaced intervals along the length of the hinge 10 than adapter clip 70 to support the cover 60. However, the overall complete cover system cover in some applications may be less expensive despite using a greater number of clips 90 because the short clips are cheaper to produce.

It should be recognized that by adding the bearing locking grooves 72 shown in FIGS. 8 and 9 to cover adapter clips 70 and 90, respectively, much larger bearing surfaces 50*a* (see FIGS. 3A-G) can be molded into the geared bearing inserts 30. The effective size of the outer cover 60 is not affected as long as the bearing portion diameter of the adapter clips 70, 90 do not exceed the tip radius of the gear sectors 32. However, because any increase in the outer diameter of the bearing portion 50 of geared bearing insert 30 greatly increases the overall effective bearing surface area 50*a* at the interface between abutting geared bearing inserts, the load and Wear resistance of the hinge 10 advantageously is greatly increased without increasing the diameter of the hinge pin 20.

Figure 13:
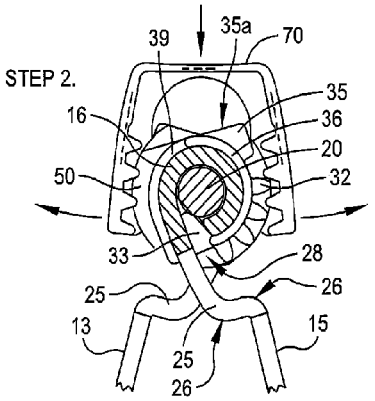
Figure 14:
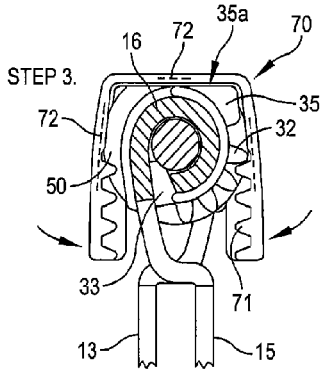

Preferably, the cover adapter clip 70 or 90 is a resilient and elastically deformable member having an elastic memory that may be suitably structured and made from a flexible material. In one, cover adapter clip 70 or 90 may be made of any suitable elastically deformable polymer. Cover adapter clip 70 and 90 are operable so that the lateral sidewalls 74 may expand outwards and contract inwards transversely/laterally as shown in FIGS. 12-14 (see lateral directional deformation arrows). Accordingly, cover adapter clips 70, 90 have a wall thickness selected that provides sufficient structural strength for positively engaging gear sectors 32 and bearing portions 50 of geared bearing insert 30 and articulating the cover 60, while at the same time being thin enough to provide suitable resiliency. Advantageously, this allows the cover adapter clip 70 or 90 to be readily installed by sliding the clip laterally onto the hinge 10 after the hinge is mounted to a pair of pivotably movable hinge objects (e.g. door and door frame) with the geared bearing inserts 30, knuckles 16, 18 and hinge pin 20 already assembled such as shown in FIG. 7. The teeth 81 on the cover adapter clip 70 or 90 will ratchet and ride over the corresponding teeth 34 on geared bearing inserts 30 until the adapter clip is fully seated on hinge 10 as shown in FIG. 14. Cover adapter clip 70 or 90 therefore resiliently snaps and locks into place over hinge 10 and geared bearing inserts 30. It should be noted that cover adapter clip 70 or 90 provides structural support for cover 60 which is intended to be a generally non-loading bearing component.

Figure 15:
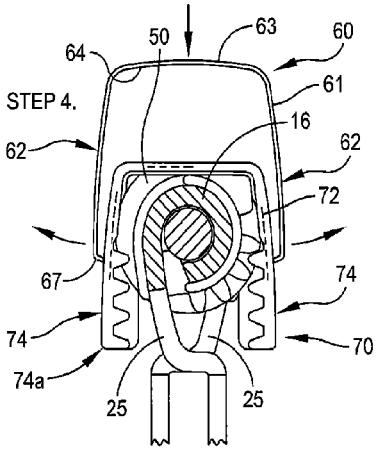

Outer cover 60 will now be further described. Referring to FIGS. 7 and 15, cover 60 serves to at least partially conceal the knuckles 16, 18 from plain sight, and to offer some protection from the environment. Cover 60 preferably has a transverse shape or profile (viewed from the end as in FIGS. 15 and 16) that complements the shape or profile of cover adapter clip 70 so that the cover closely conforms to the profile of the cover adapter clip when mounted thereon. Cover 60 includes an elongated body 61 having two ends 65, two opposing lateral sidewalls 62 which may be in general parallel relationship in some embodiments, a top 63, and an open bottom 66. Cover 60 defines an internal longitudinally-extending cavity 64 that is configured and dimensioned to receive cover adapter clip 60 or 90 therein when the cover is snapped into place on the adapter clip. Preferably, cover 60 has a sufficient longitudinal length to cover all knuckles 16, 18 in hinge 10. The longitudinal or axial configuration of the cover 60 further conforms to and complements the longitudinal or axial configuration of the cover adapter clip 70.

Figure 16:
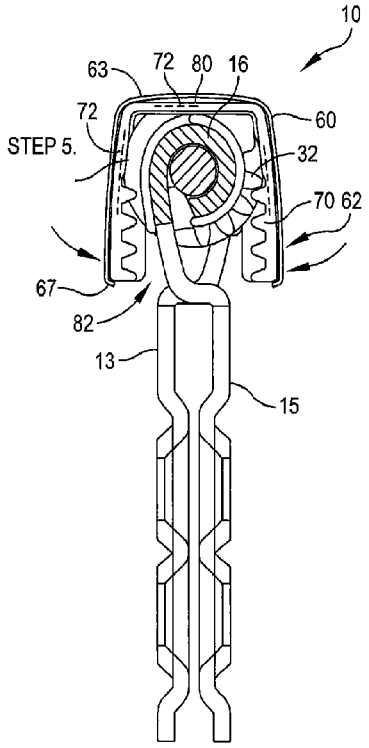

Cover 60 is retained by friction on cover adapter clip 70, and helps to clamp the preferably plastic adapter cover firmly around the geared bearing inserts 30 or 40. To facilitate attachment of the cover 60 to cover adapter clip 70, the lower edges of lateral sidewalls 62 may be terminated with an inward angled or curved lip 67 that extends longitudinally for preferably the entire length of the cover (see FIG. 15). Longitudinally-extending lip 67 is configured and dimensioned to slip underneath and grip the longitudinally extending edge 74*a* of lateral sidewalls 74 as shown in FIG. 16 to securely snap lock and hold cover 60 in place over cover adapter clip 70.

With continuing reference to FIGS. 7 and 15, outer cover 60 is preferably a resilient and elastically deformable member similar to cover adapter clip 79, 90 and has an elastic memory. Cover 60 is therefore preferably made of a sufficiently flexible material and structured to permit lateral expansion and contraction of sidewalls 62 similarly to that already described for cover adapter clip 60, 90 so that cover 60 may be snapped laterally into place over cover adapter clip 60 or 90 (see, e.g. FIG. 16).

In some embodiments, the maximum thickness for an elastically deformable and resilient thin metal cover 60 suitable for roll forming and flexing over the cover adapter clips is preferably about 1/32 of an inch (0.03125 inches or 0.794 mm). In one embodiment, a representative thickness for an elastically deformable thin metal cover 60 is without limitation about 1/64 of an inch (0.0156 inches or 0.396 mm). The cover 60 could be made a bit thinner for chromed steel or stainless steel construction, a bit thicker for aluminum, and about the same as the foregoing thickness for brass. The thickness would be somewhat dependent on the temper or hardness of material. For example, the thickness could be adjusted and lowered for ½ hardened stainless steel if more spring-back or resiliency is needed for cover 60. Other suitable thicknesses may be provided.

Because outer cover 60 is supported by cover adapter clip 60, 90 and in preferred embodiments does not contain gear racks or similar structures functioning to mechanically articulate the cover assembly, the cover may have a substantially thinner wall thickness in contrast to the adapter clip. In some embodiments, a thin-walled cover 60 may be made for example by roll forming a thin pliable metal sheet which acts like a resiliently deformable spring when the cover is snapped over cover adapter clip 70. Cover 60, being at least partially flexible and non-rigid after forming, can be applied laterally onto cover adapter clip 70 after the cover adapter clip 70 is mounted on pinned hinge 10.

In some embodiments, the hinge cover system described herein permits the user to install a cover 60 made of any suitable elastically deformable metal capable of being roll formed or stamped and having any metal finish (e.g. brushed stainless, chromed steel, brass, embossed or antiqued copper, etc.) to match a wide variety of commercially available lockset finishes. In other embodiments, cover 60 may be made of a molded or extruded polymer or plastic. Cover 60 may further provide a frame for accepting wall paper, fabric, wood veneer or other desired finish and texture to match the décor.

Figure 21:
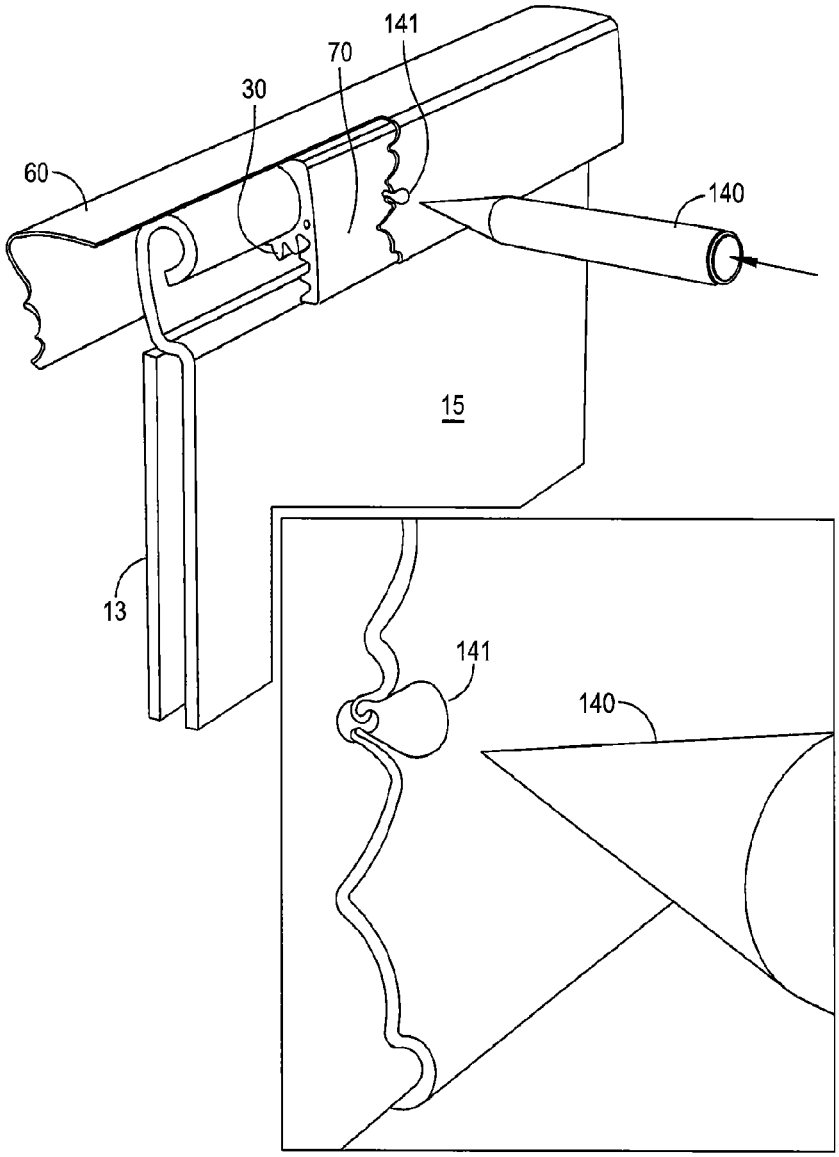
FIG. 21 shows one embodiment of a staked hinge cover for increasing frictional resistance between the cover adapter clip and cover to prevent relative movement.

Additional fixation of the cover 60 to cover adapter clips 70 or 90 may be obtained via one or more manually or machine-applied staking or dimpling operations which produce one or more projections of the cover material which can interact with and engage the cover adapter clips to further secure the cover from both lateral and longitudinal displacement with respect to the cover adapter clip. FIG. 21 shows one possible embodiment of a staked metallic cover 70 and punch 140 that may be used to create dimpling 141 in which the cover material is at least partially embedded into a plastic cover adapter clip. Multiple dimples 141 may be created either in the factory for a pre-hung door or in the field after installation of the hinge and cover adapter clips as necessary to prevent sliding movement between the cover and cover adapter clips. The selection of tools and methods for securing the cover in this manner are well within the purview of those of ordinary skill in the art to select and will not be expounded upon herein in detail.

In alternative embodiments contemplated, a fastener such as without limitation a self-tapping screw may be driven through cover 60 into cover adapter clip 70 or a machine screw inserted into a pre-threaded hole formed in the cover adapter clip through an aperture in the cover may be used to stake the cover 60 to cover adapter clips 70 or 90 and eliminate relative movement therebetween. It will be appreciated, however, that such staking means are optional because the spring-like cover may typically have sufficient clamping and frictional hold to the cover adapter clip to obviate the need for staking in many applications. Furthermore, in other possible embodiments, the outer surface of the cover adapter clip 70 or 90 that engages the cover 60 may include one or a plurality of raised surface protuberances (for example, without limitation ribs of any suitable pattern, arrangement, number and size, nubs, etc.) or surface texturing (for example, without limitation roughening, knurling, etc.) suitable to increase the friction between the cover and cover adapter clips. A negative of such protuberances or texturing may be incorporated into the molds used for forming the preferably plastic cover adapter clips. In other possible embodiments, such protuberances or texturing may be formed on elastomeric patches or inserts that may be affixed to the cover adapter clips via adhesives or co-molded with the clips. In some embodiments, planar elastomeric patches may be used without protuberances or texturing as plain elastomeric material itself creates considerable frictional resistance without any additional raised or textured surface features. It is readily within the ambit of those skilled in the art to understand and implement the foregoing friction increasing surface features without undue experimentation or further description herein. In other possible embodiments, the addition of liquid or more viscous creamy-consistency type semi-permanent or peelable adhesives can be used to prevent longitudinal movement of the cover, but allow for cover removal if needed. Also, adapter clips with end caps molded integral (at one end only) can be used to prevent end-wise or longitudinal axial movement, assuming that the adapter clip is molded with one or more means of preventing endwise movement as already described.

An exemplary method of assembling hinge 10 and the present cover and load bearing system will now be briefly summarized. FIGS. 6 and 7 show portions of hinge 10 in the form of a continuous type pinned hinge. FIG. 6 shows hinge members 12 and 14 positioned laterally aside of each other with geared bearing inserts 30 pre-mounted on the knuckles of each hinge in the manner already described herein. Anti-rotation tab 33 of geared bearing insert 30 is seated in a respective longitudinally-extending slot 28 of each knuckle 16, 18 and arcuate wall 36 which acts as a collar is wrapped around each knuckle. Knuckles 16 of hinge member 12 are inserted laterally between knuckles 18 of hinge member 14 until planar annular bearing surfaces 50*a* (on bearing portions 50 of each geared bearing insert 30) and knuckles 16, 18 become axially concentrically aligned with each other. Adjacent and mutually engaged bearing surfaces 50*a* form pairs of geared bearing inserts 30 between the knuckles as shown with the bearing portions being proximate to each other to mutually engage their respective annular bearing surfaces 50*a*. Next, pin 20 is longitudinally inserted through knuckles 16, 18 and geared bearing inserts 30 to pivotably connect hinge member 12 to hinge member 14 as shown in FIG. 7. The joined hinge members 12, 14 are now ready for receiving and mounting of the cover components.

FIGS. 12-16 shows end views of the sequential process steps for mounting inner cover adapter clip 70 and outer cover 60 onto hinge 10. These end views may represent top views looking downwards along longitudinal axis LA (extending out of the page) with the leaves 13, 15 being previously mounted on a pair of hinged objects such as a door and door frame. Hinge 10 is in a similar condition shown in FIG. 7 with geared bearing inserts 30 installed on hinge knuckles 16, 18.

FIG. 12 shows cover adapter clip 70 positioned to be laterally applied to hinge 10 (i.e. in the direction of the transverse axis TA, as shown in FIG. 7). FIG. 13 shows cover adapter clip 70 being laterally applied to and initially engaging hinge 10. Gear racks 71 on the cover adapter clip 70 slidably incrementally engage gear sectors 32 on geared bearing inserts 30. Abutted pairs of bearing portions 50 disposed on the geared bearing inserts 30 slidingly enter bearing locking groove 72 (showing only portions of groove 72 in dashed lines) on the cover adapter clip 70 shown in FIG. 8 (but not visible in FIG. 13). This engagement causes lateral sidewalls 74 of cover adapter clip 70 to deflect and expand/spread outwards radially away from knuckles 16, 18 and pin 20 of hinge 10, as shown by the directional arrows as gear sectors 32 ratchet over gear racks 71. FIG. 14 shows cover adapter clip 70 fully seated and engaged with hinge 10. Sidewalls 74 contract radially inwards back toward their original undeflected configuration to snap lock cover adapter clip 70 onto hinge 10. Bearing portions 50 on geared bearing insert 30 are located in locking groove 72 on cover adapter clip 70. Cover adapter clip 70 is now fully operably connected and mechanically coupled with hinge members 12, 14 via gear racks 71 and gear sectors 32 such that opening and closing leaves 13, 15 articulate the cover adapter clip with respect to pin 20 and knuckles 16, 18.

With cover adapter clip 70 coupled to hinge 10, outer cover 60 may now be applied as shown in FIGS. 15 and 16. FIG. 15 shows cover 60 in the process of being laterally applied and clamped onto cover adapter clip 70. Sidewalls 62 of cover 60 engage sidewalls 74 of cover adapter clip 70, wherein longitudinally-extending lips 67 on each sidewall 62 may make linear contact with sidewalls 74 as shown. This causes sidewalls 62 to temporarily flex and resiliently deflect radially and laterally outwards away from cover adapter clip 70 as well away as pin 20 and knuckles 16, 18, as shown by the directional arrows in FIG. 15, due to the at least laterally flexible structure of the cover. When cover 60 becomes fully seated on cover adapter clip 70 as shown in FIG. 16, sidewalls 62 resiliently contract inwards (see directional arrows) back towards their original undeflected configuration to snap lock cover 60 onto cover adapter clip 70.

With continuing reference to FIG. 16, longitudinally-extending lips 67 fully engage and slip underneath longitudinally extending edge 74*a* of lateral sidewalls 74 as shown to securely clamp the cover 60 to cover adapter clip 70 which is retained by friction. As shown, cover 60 closely conforms to the profile shape of cover adapter clip 70 in the embodiment shown. Cover 60 will now move concomitantly in unison simultaneously with displacement and articulation of cover adapter clip 70 caused by opening and closing hinge 10. FIG. 16 shows hinge 10 in a fully "closed" position.

After the cover adapter clip 70 is snapped over the hinge knuckles 16, 18 (only one cover adapter clip being needed for each butt hinge in a pinned butt hinge type installation), several more adapter clips 70 (FIG. 8) or 90 (FIG. 9) may be mounted in a similar manner and longitudinally spaced along the length of a continuous type pinned hinge. It is well within the ambit of those skilled in the art to select the proper number and spacing of cover adapter clips 70 that are required to properly support the cover 60 and provide adequate vertical load bearing capacity for hinge. The preferably roll formed or stamped cover 60 in some embodiments is then snapped over the adapter clip (for butt hinges) or multiple adapter clips 70 (for continuous hinges) and is retained in place by the cover's own self-clamping action, which also keep the adapter clip(s) tightly seated for proper indexing of the gear sectors 32 that ultimately positions the entire cover 60 on hinge 10. The cover 60 is retained in place by friction as already described, or by supplemental pinning or fastening of the cover into the cover adapter clip 70 such as by threaded fasteners, pins, or other fastening devices commonly known in the art. It should be noted that the larger diameter bearing portions 50 rotating within the circumferentially oriented locking grooves 72 formed in the cover adapter clip 70 (see, e.g. FIG. 8) also helps to keep the adapter clip from moving longitudinally with respect to the hinge members 12, 14. The gear bearing inserts 30 lock into the knuckle edges as already described herein to prevent rotation, causing bearing portions 50 of the inserts to turn against each other rather than against the rough knuckle edges.

It will be appreciated that the present two-piece cover system including cover adapter clip 70 and cover 60 may advantageously be mounted on hinge 10 before or after leaves 13, 15 are mounted to a pair of hinged objects such as a door and corresponding door frame. In addition, because both cover adapter clip 70 and cover 60 are elastically deformable at least in the lateral or transverse direction to the longitudinal axis LA, these components may be laterally applied to hinge 10 with the hinge in the fully "closed" position as shown in FIGS. 16 and 17A. Such is not the case with hinges having a one-piece rigid metal cover with integral gears that cannot laterally flex sufficiently to snap in place over already assembled and pinned hinge members in the fully closed position, such as disclosed in U.S. Pat. No. 5,991,975.

Accordingly, embodiments of the two-piece cover system according to the present invention advantageously allow the installer to first mount the hinge 10 to the pair of hinged objects to be pivotably connected, adjust the hinge to the fully closed position with leaves 13, 15 together (see, e.g. FIGS. 12-16), and then snap on both the cover adapter clip 70 and then cover 60 with the hinge already securely positioned and mounted. This allows the installer to ensure that the hinge 10 is operating properly and to inspect and/or adjust the hinge members as needed before finally snapping the cover adapter clip 70 and cover 60 laterally over the hinge members 12, 14. In addition, the resilient snap fit cover system components comprising cover adapter clip 70 and cover 60 can be advantageously be installed quickly without cumbersome manipulation that may otherwise be needed to align and mesh gear racks and gear sectors. Also, a hinge constructed with the components described does not require the factory floor space of other covered continuous hinges which are endwise assembled. Further, the cover may be laterally removed and replaced on an already installed hinge at any time to easily restore a damaged surface, renew its finish or to change its color or material.

For a continuous type pinned hinge installation, a portion of which is shown in FIG. 7, it will be appreciated that the cover 60 extends for substantially the entire length of the hinge 10. In contrast, the cover adapter clips 70 (or 90 if used) are substantially shorter in axial length because the adapter clips only extend longitudinally to cover a central knuckle 18 and portions of two adjacent knuckles 16.

In addition, it should be noted that cover adapter clips 70 or 90 when used for a longitudinally-extending continuous type pinned hinge may be used in conjunction with additional non-geared bearings disposed between some pairs of adjacent mating knuckles, or alternatively no additional bearings other than geared bearing inserts 30, 40 because only a sufficient number of cover adapter clips need be used to properly support cover 60 and to support the longitudinal endwise loads imposed by a hinged object on the hinge.

Figure 18A:
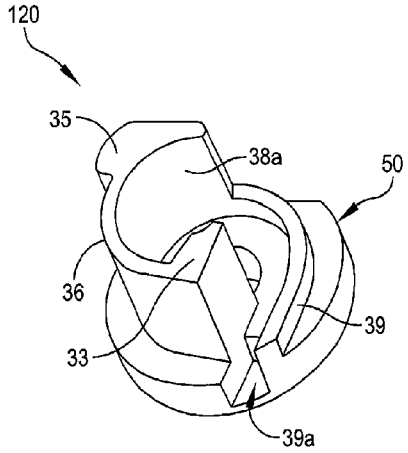
FIG. 18A-18B show a non-geared bearing insert useable in the hinge of FIG. 1.
Figure 18B:
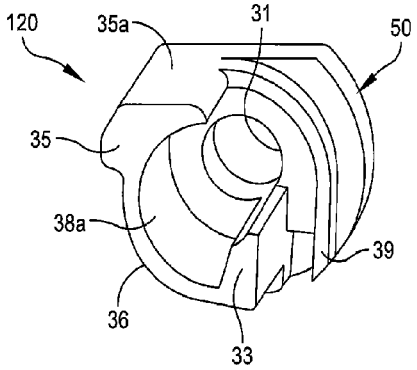

If used, the non-geared bearings may be interspersed along the axial length of hinge 10 between geared bearing inserts 30 or 40. Accordingly, in some embodiments as shown for example in FIGS. 18A and 18B, bearing inserts 120 that lock into knuckles 16, 18 using locking tab 33 may be used which are configured the same as geared bearing insert 30 or 40 shown in FIGS. 3 and 4, but without any gear sectors 32 and rotational stops 35 because inserts 120 do not operably engage cover adapter clip 70 or 90. In such embodiments, arcuate wall 36 may be plain and serves as a collar that is slipped over the knuckle 16 or 18 with only locking tab 33 disposed at one end of the arcuate wall to assist with securing the non-geared bearing insert 120 to the knuckles. In alternative embodiments, conventional non-geared bearings may be used as will be readily known to those skilled in the art, such as without limitation those described in U.S. Pat. Nos. 4,097,959 and 3,499,183 where are incorporated herein by reference in their entireties.

The articulating cover system disclosed herein, which includes cover adapter clip 70 and cover 60, is mechanically articulated via the geared mechanism shown and described herein in the same general manner disclosed in the inventor's U.S. Pat. Nos. 5,991,975 and 6,859,980, which are both incorporated herein by reference in their entireties.

Operation of the articulating cover system will therefore now be briefly described. FIGS. 17A-17C sequentially show hinge 10 in an operation. Bearing portions 50 of the geared bearing inserts 30 are not shown in these figures to more clearly show the movement of gear sectors 32.

FIG. 17A shows covered pinned hinge 10 in the "closed" position with the leaves 13, 15, of hinge members 12, 14, respectively, in relatively close proximity or abutting relationship to each other. For purposes of described the hinge 10 operation, it will be assumed that hinge member 12 (with leaf 13 as shown) remains stationary such as if being fixedly mounted to a building structure like a door frame while opposing hinge member 14 (with leaf 15 as shown) is movable such as being fixedly mounted to a swinging door. In the embodiment shown, the left side visible gear tooth sector 32 of forward most geared bearing insert 30 is engaged with primarily the upper teeth 81 of side gear rack 71 on the left side of cover adapter clip 70. In one embodiment, as shown, only the upper tooth 81 of gear racks 71 may be engaged with a single upper tooth 34 of gear sector 32. As also shown in FIG. 16, cover adapter clip 70 and cover 60 are proximate to and in their respective closest positions nearest pin 20 and knuckles 16, 18 (note positions of tops 80 and 63 of cover adapter clip 70 and cover 60 respectively near the pin 20 and knuckles). Stop 35 is positioned in the uppermost part of upper interior portion 76*a* (see also FIGS. 12-14). There may be either a negligible gap or no gap at all between the interior surface 79*a* adjacent to top 80 of cover adapter clip 70 and planar surface 35*a* of motion-limiting stop 35 if both surfaces are mutually abutted. Sidewalls 74 and 62 of cover adapter clip 70 and cover 60 respectively are oriented generally parallel to leaves 13, 15 as shown.

FIG. 17B shows hinge 10 in a partially open position between 0 degrees shown in FIG. 17A and 180 degrees shown in FIG. 17C. Hinge 10 is approximately 90 degrees in a partially open position in FIG. 17B. In the embodiment shown, as the hinge 10 is progressively opened, movable leaf 15 of hinge member 14 pivots counterclockwise around the pin 20 towards the hinge "open" position shown in FIG. 17C. The left visible gear sector 32 shown will travel downwards along the left side gear rack 71 towards open bottom 82 of cover adapter clip 70 (compare FIG. 16 with FIG. 17) as the clip and cover 60 rotate around pin 20. Concomitantly, the gear sector 32 on geared bearing insert 30 visible on the right and positioned immediately behind the forward most visible geared bearing insert 30 having the gear sector 32 visible on left as shown in FIGS. 16 and 17 will also travel downwards along the right side gear rack 71 of cover adapter clip 70. As hinge 10 is opened, cover adapter clip 70 and cover 60 are displaced and moved radially away from and outwards with respect to pin 20 and knuckles 16, 18. This motion produces increasingly greater distance between tops 80 and 63 of cover adapter clip 70 and cover 60 respectively which are moved more distally from pin 20 and knuckles 16, 18. This allows more clearance for leaves 13, 15 to swing around and clear the longitudinally-extending lower edges 74*a* of cover adapter clip 70 and lips 67 of cover 26 as the hinge 10 without interference from the cover system.

FIG. 17C shows hinge 10 in a fully "open" position, which in this embodiment the leaves 16, 18 may be approximately 180 degrees apart. In the embodiment shown as the hinge 10 reaches the open position, the left side gear tooth sector 32 of the forward most geared bearing insert 30 shown comes to stop being engaged with the lower most teeth 81 of the left side gear rack 71 on cover adapter clip 70, and concomitantly the gear tooth segment 32 visible on the right comes to rest being engaged with the lower-most teeth 81 of the right side gear rack 71 on cover adapter clip. The rotational stops 35 of each geared bearing insert 30 abuttingly engage the gear racks 71 of cover adapter clip 70 as shown to prevent further rotation of the hinge cover system. Cover adapter clip 70 and cover 60 are distal to and in their respective farthest positions away from pin 20 and knuckles 16, 18 (note, e.g. positions of tops 80 and 63 of cover adapter clip 70 and cover 60 respectively with respect to pin 20 and knuckles). There is a greater or larger clearance/gap between the tops 80 and 63 than in FIG. 17A or 17B. In addition, it should be noted that pin 20 and knuckles 16, 18 are positioned in open bottom 82 of cover adapter clip 70. Cover adapter clip 70 is partially recessed between leaves 16, 18.

It should be noted that the fully "open" hinge position shown in FIG. 17C may only be achievable in some embodiments with a full surface mounting of hinge 10. In a half surface mounting of hinge 10, the position shown in FIG. 17B may represent a fully open position for a half surface type installation. Full and half surface hinge installations and terminology are well known to those skilled in the art without further elaboration.

It will further be appreciated that as hinge 10 moves from a fully closed position in FIG. 17A to open positions in either FIG. 17B or 17C, the mating annular bearing surfaces 50*a* on geared bearing inserts 30 or 40 are abuttingly, but rotatably in contact with each other in sliding rotational engagement as the hinge leaf 15 pivots with respect to hinge leaf 13. This sliding engagement, in some embodiments, is facilitated by the plastic-on-plastic contact between the bearing surfaces 50*a* of bearing portions 50 on the adjacent pairs of geared bearing inserts 30 or 40 which produces minimal friction without lubrication between the mating engaged surfaces.

Figure 10A:
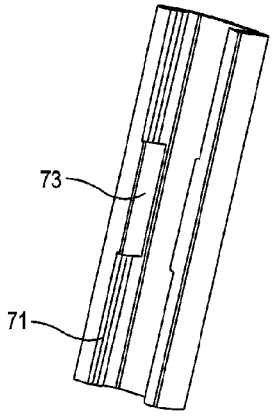
FIGS. 10A-10C are perspective views of a cover adapter clip useable with the hinge of FIG. 1 and geared bearing inserts of FIGS. 4A-C.
Figure 10B:
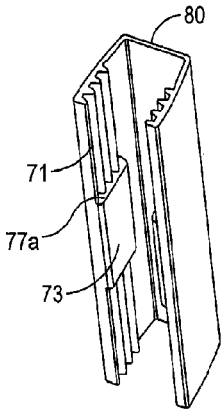
Figure 10C:
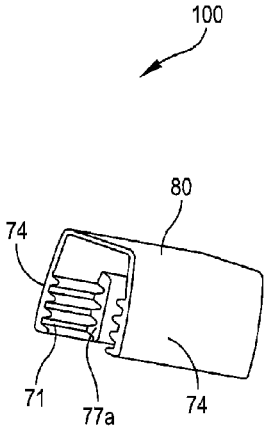

According to another aspect of the invention, FIG. 10A-10C shows perspective views of one embodiments of a cover adapter clip 100 usable with the standard duty geared bearing inserts 40 shown in FIGS. 4A-C. Cover adapter clip 100 is structured similarly to cover adapter clip 70 shown in FIG. 9 and also includes a gear rack 71 that engages and cooperates with the gear sectors 32 which are a unitary part of geared bearing inserts 40. The adapter clip 100 is preferably snapped into place with the central stop portion 73 of the adapter clip placed over the longitudinal center of a hinge knuckles 16, 18 so that the end stop surfaces 77*a* of the stop portion will remain longitudinally centered between the pairs of geared inserts 40 at the ends of the knuckle. It is not necessary to extend the stop surface 77*a* of the center portion all the way around the roof or top 80 of the adapter clip 100 for centering to occur. Because of the rotation of the geared bearing inserts 40 and the consequent motion of the adapter clip 100 with respect to the hinge center, contact and consequent centering of the adapter clip will be maintained. The adapter clip 100 can thereby be made with a minimum of material and will retain flexibility for assembly onto the hinge knuckles 16, 18 as the lateral sidewalls 74 of the clip are spread apart during attachment to the hinge as described herein.

It should be noted that because geared bearing inserts 40 shown in FIGS. 4A-C do not extend diametrically beyond the root diameter of gear teeth 34, there is no need for locking grooves 72 (as shown in FIG. 8 for geared bearing inserts 30) which are preferably absent from both cover adapter clips 100 and 110 described below.

Figure 11A:
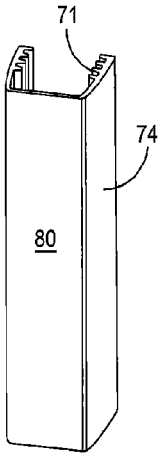
FIGS. 11A-11C are perspective views of an alternative cover adapter clip useable with the hinge of FIG. 1 and geared bearing inserts of FIGS. 4A-C.
Figure 11B:
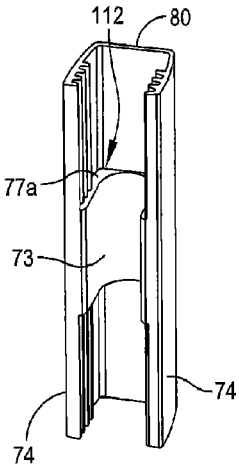
Figure 11C:
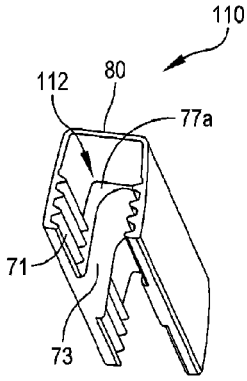

FIGS. 11A-11C show an alternative embodiment and variation of a cover adapter clip 110 for use with the standard duty geared bearing inserts 40 shown in FIGS. 4A-C. In contrast with cover adapter clip 100 shown in FIGS. 10A-10C, cover adapter clip 110 has a central stop portion 73 that is continued over the roof or top 80 of the adapter clip to more fully engage the geared bearing inserts 40 between the knuckles 16, 18, as well squared-off corners 112 of the inserts to assist in maintaining the adapter clip's position with respect to the knuckles to which they may be attached. The squared corners 112 of the inserts serve to prevent the adapter clip 110 from becoming radially misaligned during assembly. The corners 112 of the geared bearing inserts 40 allow the adapter clip 110 to be pressed firmly into position without danger of improper indexing of its gear racks 71 with respect to the gear sectors 32 of the inserts, and the design of the adapter clip 110 in FIGS. 11A-11C takes advantage of the additional endwise support of the adapter clip, and consequently of the roll-form cover 60 which depends on the longitudinal positioning of the adapter clip for maintaining its own longitudinal position.

It should be noted that cover adapter clips 100 and 110 are generally structured and include the same appurtenances and features as cover adapter clips 70 and 90, with exception of the features noted above. Functionally, cover adapter clips 100 and 110 operably engage and Mechanically articulate the cover system in the same manner already described.

Figure 19C:
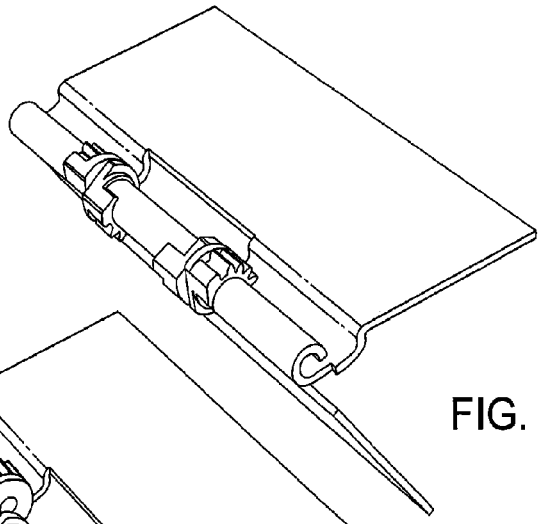
FIGS. 19A-19C show sequential assembly drawings of an embodiment of a three-leaf butt hinge with the geared bearing inserts of FIGS. 3A-G (without cover adapter clip or cover shown)
Figure 19B:
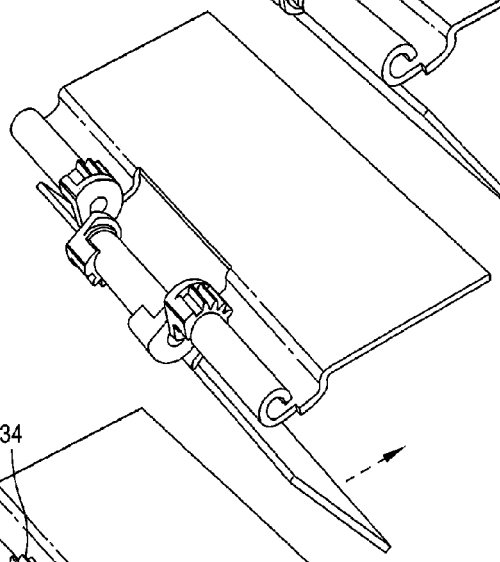
Figure 19A:
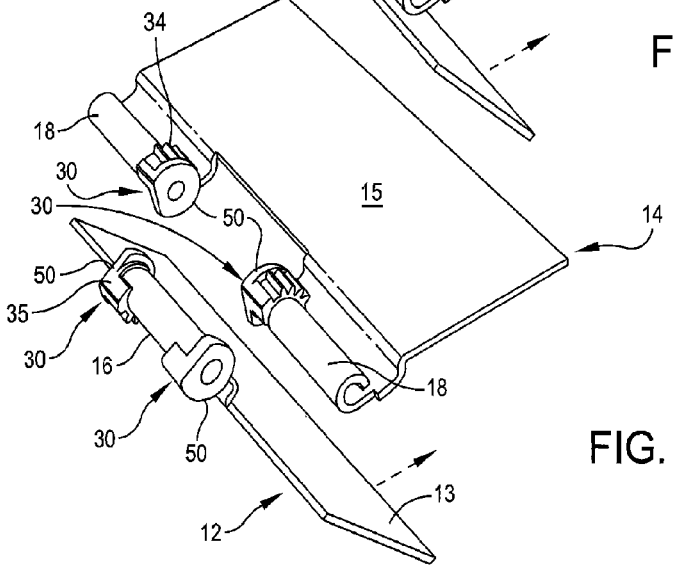

FIGS. 19A-C show an embodiment of a three-leaf butt hinge 10 according to principles of the present invention during three sequential lateral assembly steps with knuckles 16 of hinge member 12 having geared bearing inserts 30 already mounted thereon being laterally inserted between knuckles 18 of hinge member 14 also having geared bearing inserts 30 mounted thereon. As shown, each adjacent opposing pair of bearing inserts 30 are oriented and mounted on hinge members 12, 14 such that the gear tooth segment or sectors 32 of each insert face in opposing lateral directions transverse to the longitudinal axis of the hinge. The articulating cover system including cover adapter clip 70 and cover 60 would then be laterally applied and mounted afterwards on hinge 10. After knuckles 16 and 18 of hinge members 12 and 14 respectively are axially aligned as shown in FIG. 19C, pin 20 would then be inserted (see also FIG. 6), followed by lateral application of inner cover adapter clip 70 and then outer cover 60 over the knuckles 16, 18 and geared bearing inserts 30 as shown in FIGS. 12-16.

Two-Piece Cover Adapter Clips

Figure 22:
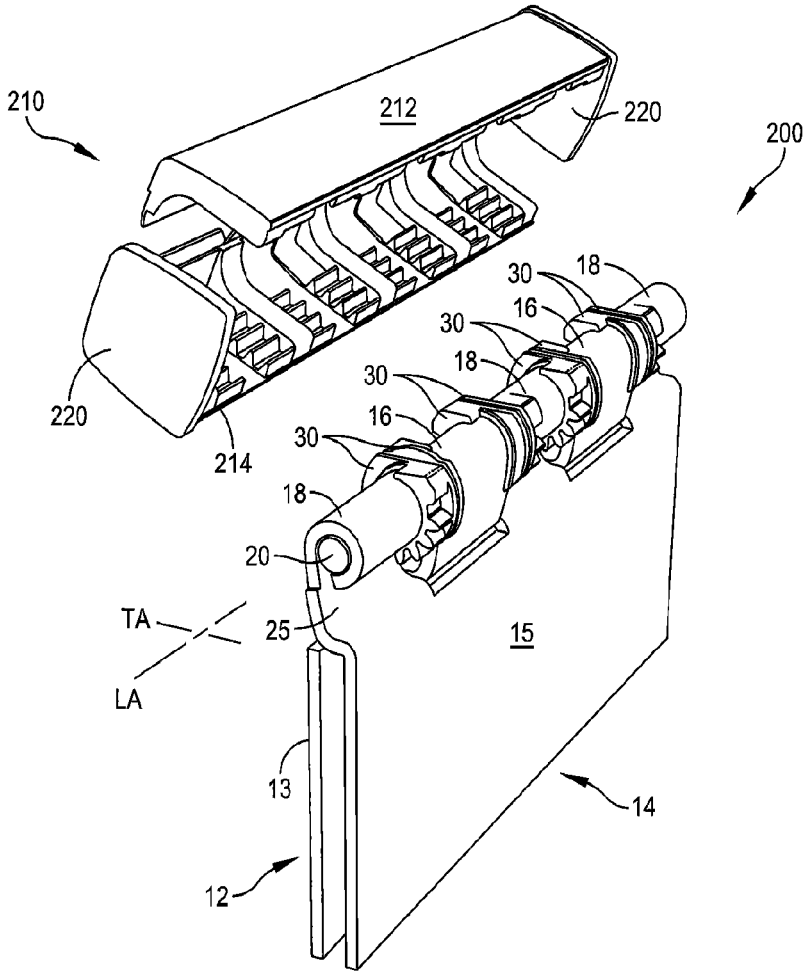
FIG. 22 is a perspective view of a two-piece embodiment of a cover adapter clip being assembled to a hinge.

According to other aspects of the present disclosure, alternative embodiments comprising a two-piece cover adapter clip 210 are provided that are longitudinally split in half and/or that includes one or more integrally formed end caps 220 (see, e.g. FIG. 22). In instances where a three knuckle butt hinge is encountered, one pair of geared bearing inserts 30 or 40 each are mounted between knuckles 16 and 18 as shown for example in FIG. 7. The cover adapter clip 70 shown in FIG. 7 without end caps, which in one embodiment is plastic and molded as a monolithic unitary structure, may be molded in the endwise direction having a transverse mold parting line midway along the length of the clip as will be readily known to those skilled in the art, thereby allowing for easy axial separation of the two mold halves along the parting line to eject the molded part. However, if the adapter clip 70 must span more than three knuckles and two spaced apart pairs of geared bearing inserts 30 or 40 as described above, and/or will include end caps, the internal gear racks in the adapter clip prevent separation of the molded part from the mold unless more complex molding techniques and apparatuses such as cam-operated molds are be used.

To overcome the foregoing molding obstacles for longer adapter clips and/or those which include end caps, a two-piece longitudinally divided or split cover adapter clip 210 is provided having two mating complementary configured halves which may be molded separately and then joined together afterwards on the hinge.

FIG. 22 shows an exemplary embodiment of a five knuckle pinned butt hinge 200 including a two-piece elongated cover adapter clip 210 with end caps 220. Cover adapter clip 210 is split vertically along a centerline corresponding to longitudinal axis LA and comprises two half sections 212, 214 which are abutted together when applied to hinge 200. In one embodiment, as shown, each half section 212, 214 may be configured in transverse cross-section as one-half of a U shape. Cover adapter clip 210 is configured to receive cover 60 thereon in the same manner as previously described herein with respect to cover adapter clips 70 and 90, and includes a top surface 280 longitudinally extending between end caps 220. In one embodiment, cover adapter clip 210 is made of molded polymer or plastic as already described herein. Features of the hinge 200 including hinge members 12, 14 and related components, and geared bearing inserts 30 are similar to pinned hinge 10 as previously described herein. Alternatively, bearing inserts 40 may be used in some embodiments.

Figure 23:
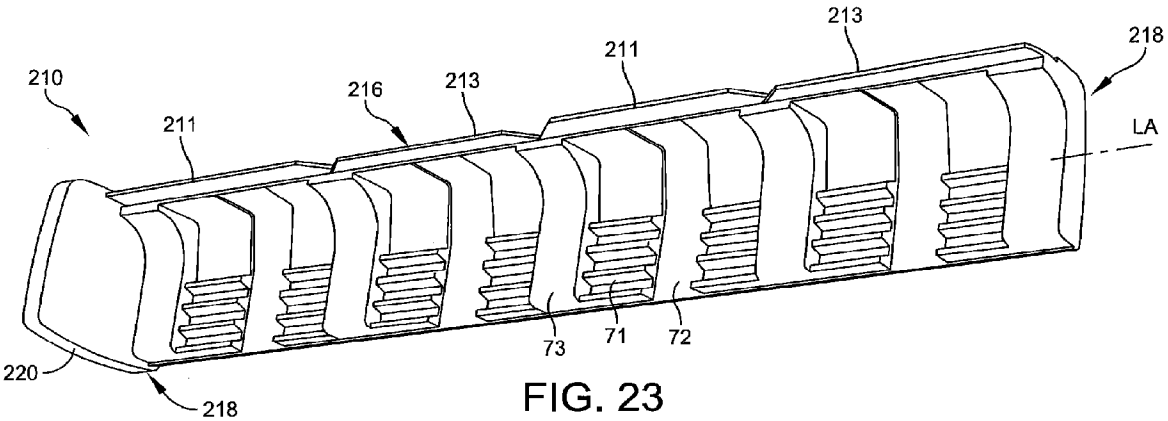
FIGS. 23-26 are various perspective view of the two-piece cover adapter clip of FIG. 22 in varying preassembly positions.
Figure 24:
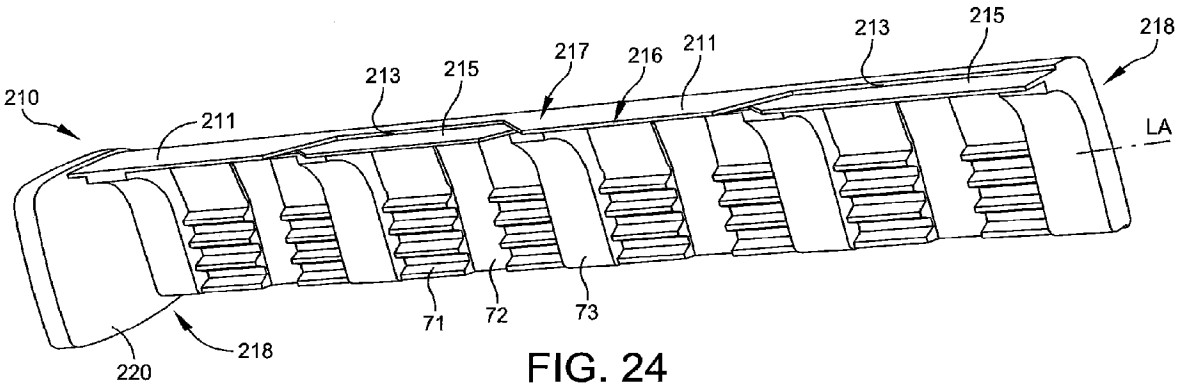
Figure 25:
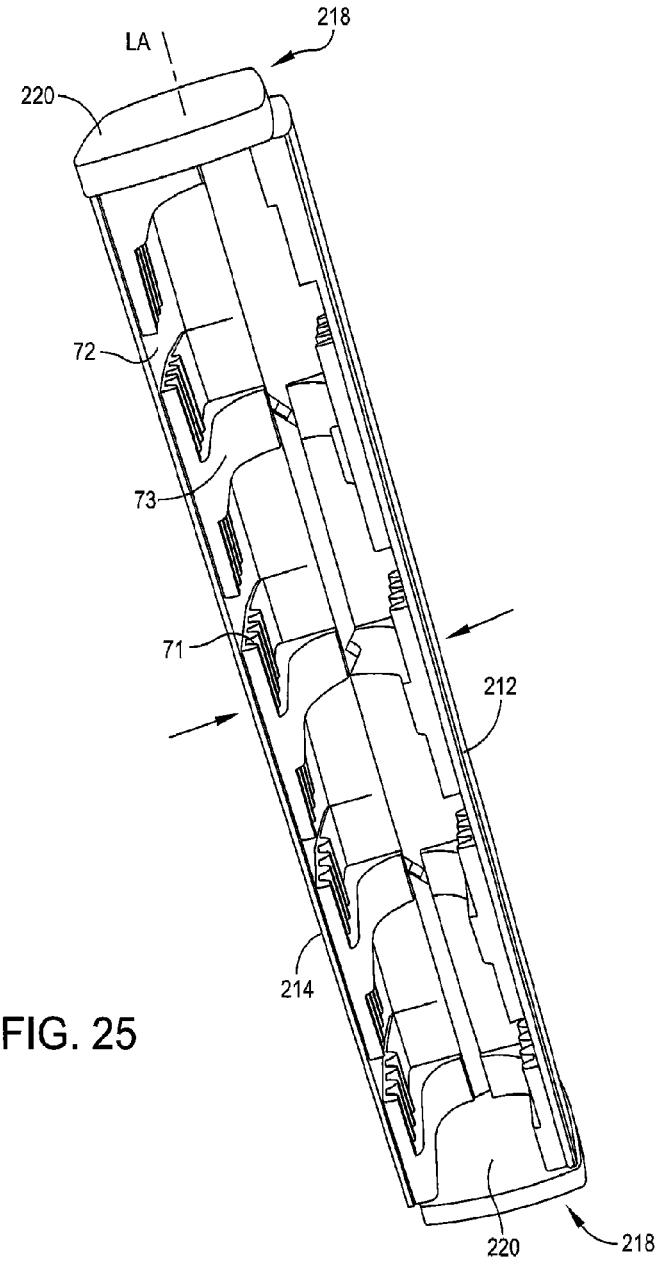

FIGS. 23-25 depict additional views of cover adapter clip 210 showing internal features. Referring to FIGS. 22-25, cover adapter clip 210 includes features similar to cover adapter clips 70 and 90 are previously described, including opposing gear racks 71, opposing bearing locking grooves 72 which receive bearing portions 50 of geared bearing inserts 30 therein, and raised saddle or stop portions 73 which fit over knuckles 16, 18 of hinge 200. In one embodiment of cover adapter clip 210 configured for a five knuckle butt hinge 200, as shown, five stop portions 73 which correspond to the number of knuckles 16, 18. Because the cover adapter clip 210 completely encloses all five knuckles, a stop portion 73 is provided on each end of the clip outboard of a gear rack 71 as shown. In this embodiment, the five knuckle hinge 200 includes four axially spaced apart pairs of bearing inserts 30 and four corresponding locking grooves 72 are provided which are interspersed between gear racks 71 as shown.

Figure 29:
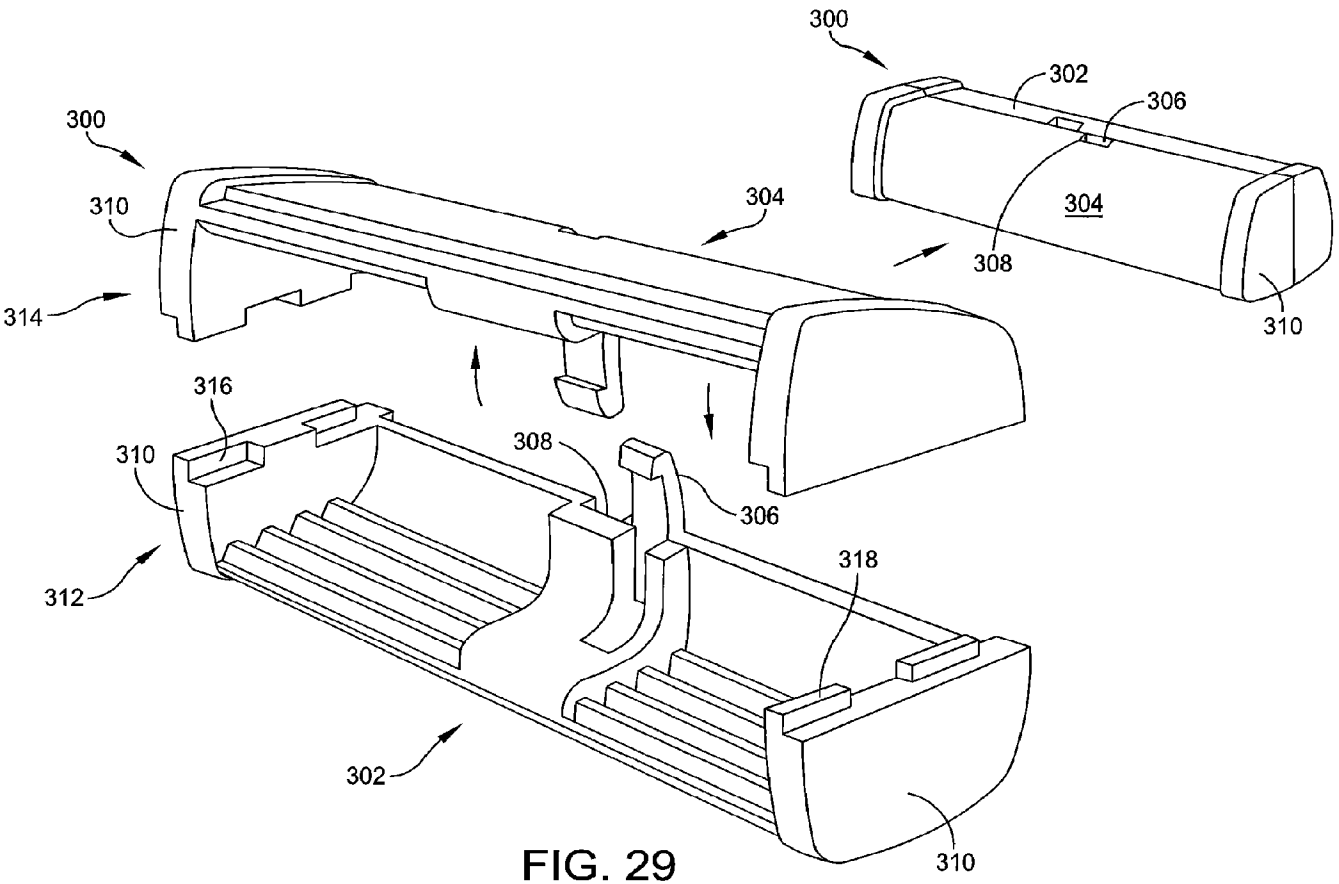
FIG. 29 is a perspective view of an alternative embodiment of a two-piece cover adapter clip with snap lock features before and after assembly.

With continuing reference to FIGS. 22-25, one end cap 220 is disposed on an end 218 of each half section 212, 214 in one embodiment. End cap 220 is configured and dimensioned to provide a full width cap and complete end cap on each half section of the cover adapter clip 210 in some embodiments as shown in which half of the cap 220 protrudes beyond and over the longitudinal axis LA and joining edge 216 of each half section. FIG. 29 shows an alternative embodiment of a cover adapter clip 300 wherein each half section 302, 304 includes a half segment 312, 314 of an end cap 310 which form a complete cap when joined together as shown. In some embodiments, each half segment 312, 314 may be mechanically joined together via interlocking mortise 316 and tenon 318 joints as shown.

Advantageously, with reference to FIGS. 22-25, a single cover adapter clip 210 and configuration may be fabricated and provided to installers because each half section 212, 214 is reversed in position and then abutted or joined together over knuckles 16 and 18. Accordingly, in some embodiments, right and left half sections 212, 214 are identical in configuration eliminating the need for distinct right and left half sections to simplify installation and inventory of parts.

In some embodiments, half sections 212, 214 may be simply abutted together and have a plain substantially straight uninterrupted longitudinal joining edge 216. A mechanical interference or adhesive type coupling are not required because resilient spring-like cover 60 snaps over cover adapter clip 210 after placement on hinge 200 and acts as a clamp to hold both half sections 212, 214 together.

Figure 26:
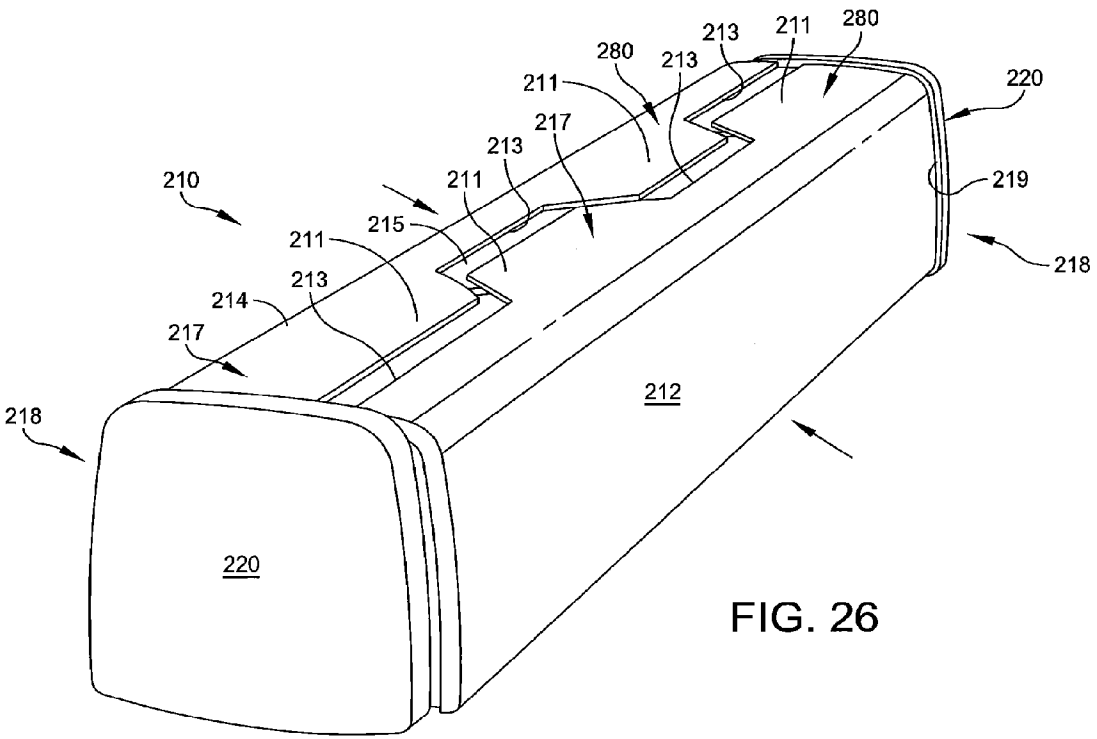

In other embodiments, a mechanically secured or locking engagement may be provided to assist with holding each half section 212, 214 of cover adapter clip 210 together until cover 60 is mounted thereover which further secures each section (best shown in FIGS. 23, 24, and 26). The mechanical coupling or joint may include engagement of the type comprising frictional, snap fit, and combinations thereof. In one possible embodiment as shown, one or more locking elements are disposed on each half section 212, 214 of cover adapter clip 210 which are cooperatively configured and located to hold the half sections together. In one possible, for example without limitation, the locking elements may be in the form of mating locking tabs 211 and locking recesses 213 which form a frictional type joint when coupled together. Tabs 211 protrude laterally and transverse to the longitudinal axis LA in some embodiments. Recesses 213 may include a flat seating surface 215 as best shown in FIG. 24 which receives tab 211 thereon to increase the frictional coupling in the joint. Seating surface 215 is arranged parallel to but recessed slightly below the outer surface 217 of cover adapter clip 210. Any suitable configuration of tabs 211 and recesses 213 may be provided so long as mechanical interlock is formed between half sections 212, 214 of cover adapter clip 210.

It will be appreciated that the cover adapter clip 210 may be readily adapted and configured for application to a three-knuckle butt hinge having two pairs of mating geared bearing inserts 30 or 40 disposed between adjacent knuckles in lieu of the five-knuckle hinge 200 shown in FIGS. 22-28 and described above. The cover adapter clip 210 may be adapted to butt hinges having any number of knuckles or a continuous style pinned hinge.

FIG. 29 shows an alternative mechanical coupling arrangement or joint for a two-piece cover adapter clip 300 in the form of an interlocking snap fit type joint comprising a flexible hook 306 and socket 308 formed on each half section 302, 304 of the clip. Sockets 308 are formed on the outer surface of the cover adapter clip 300 and hooks 306 are formed as an integral lateral extension of each clip half section which are configured to lockingly and resiliently engage a corresponding socket surface on the opposing half section. Numerous other possible frictional and/or snap-fit joints are possible including without limitation mating pins and holes, longitudinally extending tongue and groove, etc.

Because cover adapter clip 210 is provided in two complementary configured mating half sections 212, 214, the clip 210 may be more rigidly structured than the one-piece unitary cover adapter clip 70 or 90 which preferably has sufficient flexibility to be pressed laterally over the hinge knuckles 16, 18 as a single unit as already described herein. Accordingly, adapter clip 210 may advantageously be formed of harder, more rigid polymeric materials such as polycarbonates or of metal in various embodiments.

As best shown in FIG. 26, end cap 220 in some embodiments includes a return lip 219 which is raised above outer surface 212 of clip 210 to help vertically retain the snap-on cover 60 which prevents the cover from sliding axially off the ends of the hinge. According, the end caps 220 serve to not only retain cover 60, but also improves the aesthetic appearance of the hinge by hiding its internal components and prevents dirt/debris for infiltrating into the movable components (i.e. knuckles, geared bearing inserts, cover adapter clip, etc.) to ensure smooth operation of the hinge.

To assemble the two-piece cover adapter clip 210 on hinge 200, pinned butt hinge 200 is first provided with geared bearing inserts 30 (or alternatively 40) already installed as shown in FIG. 22 and described in detail herein elsewhere. One of the half sections 212, 214 of cover adapter clip 210 is laterally aligned with and positioned onto hinge knuckles 16, 18 (see also FIGS. 23-26). Gear racks 71 are engaged with geared portions 51 of bearing inserts 30 and bearing portions 50 are received in each of the bearing locking grooves 72. Raised stop portions 73 are laterally aligned with and placed over knuckles 16 and 18.

With continuing reference to FIGS. 22-26, the remaining half section 212, 214 is laterally aligned with and engaged with the already mounted half section of cover adapter clip 210. In the embodiment shown, locking tabs 211 will enter and be received in laterally opposing locking recesses 213 to secure the half sections together.

Figure 27:
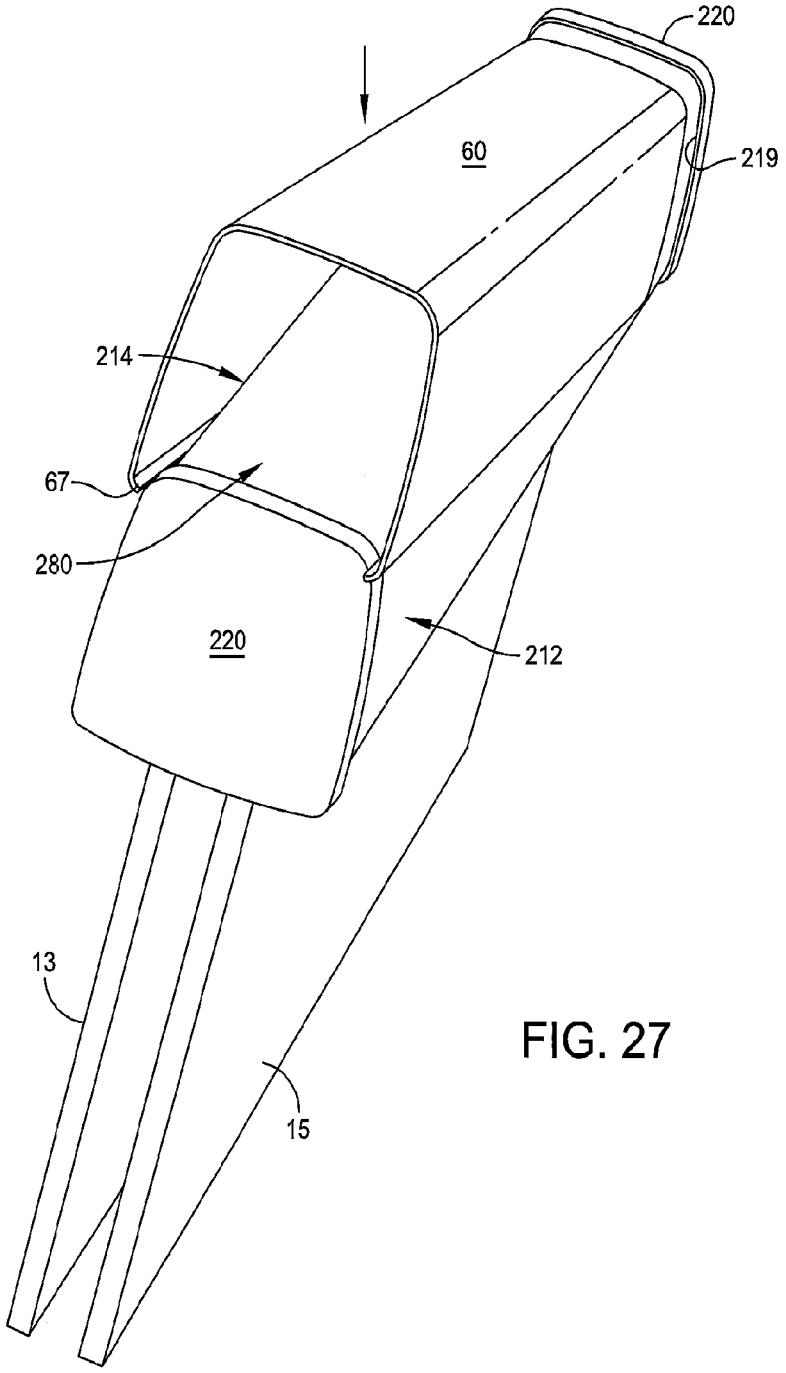
FIG. 27 shows a cover being partially mounted on the cover adapter clip of FIG. 22.
Figure 28:
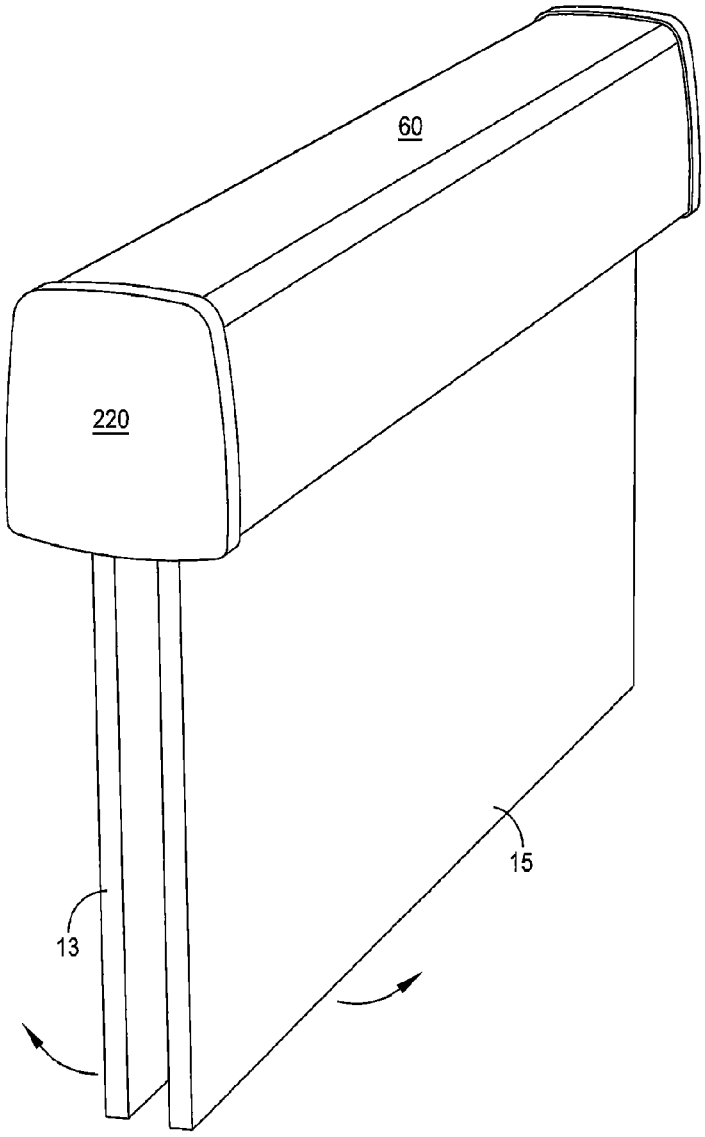
FIG. 28 shows the cover fully mounted on the cover adapter clip of FIG. 22.

After assembly of the cover adapter clip 210, the cover 60 is laterally mounted and resiliently snapped onto the clip as shown in FIG. 27 (showing partially assembly). The completed butt hinge 200 and cover 60 assembly is shown in FIG. 28, which articulates and functions in the same manner as pinned hinge 10 already described herein.

Cover adapter clip 300 shown in FIG. 29 is assembled to pinned hinge 200 in a similar manner as cover adapter clip 210 described above.

It will be appreciated that the cover adapter clip 210 may be readily adapted and configured for application to a three-knuckle butt hinge having two pairs of mating geared bearing inserts 30 or 40 disposed between adjacent knuckles in lieu of the five-knuckle hinge 200 shown in FIGS. 22-28 and described above. The cover adapter clip 210 may be adapted to butt hinges having any number of knuckles or a continuous style pinned hinge.

To accommodate a longitudinally-extending continuous type pinned hinge as described herein in lieu of axially short butt hinge arrangements, a modification to cover adapter clip 210 may be provided in which the end cap 220 is omitted from one of the mating clip half sections 212 or 214 (not shown, but sufficiently described as follows without need for illustration as will be readily understood by one skilled in the art). The cap-less half section 212 or 214 would appear as shown for example in FIG. 23, but would have both ends 218 configured the same as the end shown that does not have the cap. A cover adapter clips 210 with a single end cap 220 may be placed on the very top and bottom of the continuous hinge to provide a finished appearance concealing the operating hinge components (e.g. hinge knuckles, pin, geared bearing inserts, and etc.) disposed beneath the cover and end cap, and provide the other benefits associated with the end cap 220 as already described. The cover 60 would extend longitudinally along the entire length of the continuous pinned hinge.

Open-Sided Single Piece Cover Adapter Clips

Figure 30:
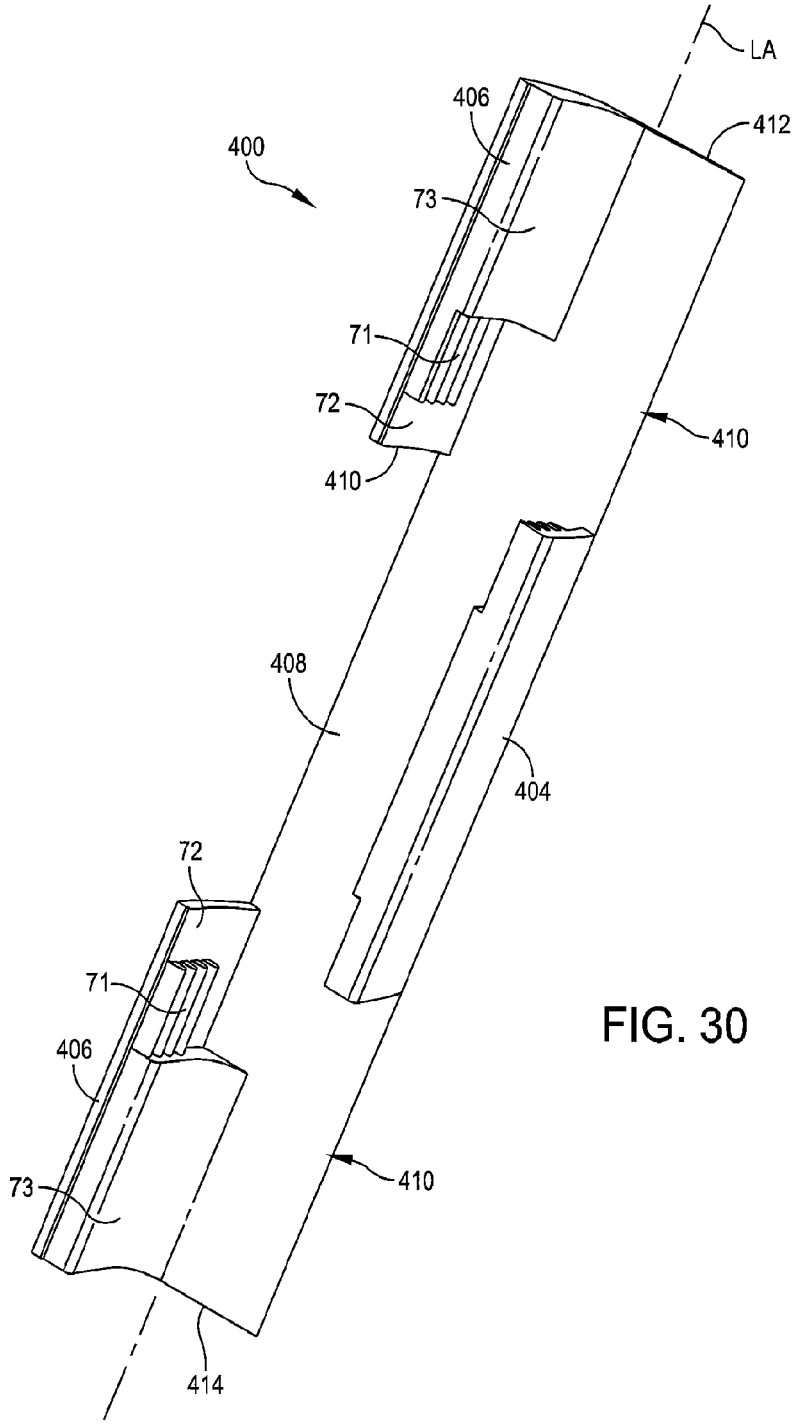
FIGS. 30-31 are perspective view of an a one-piece embodiment of a cover adapter clip having open sides for each of molding and weight reduction.
Figure 31:
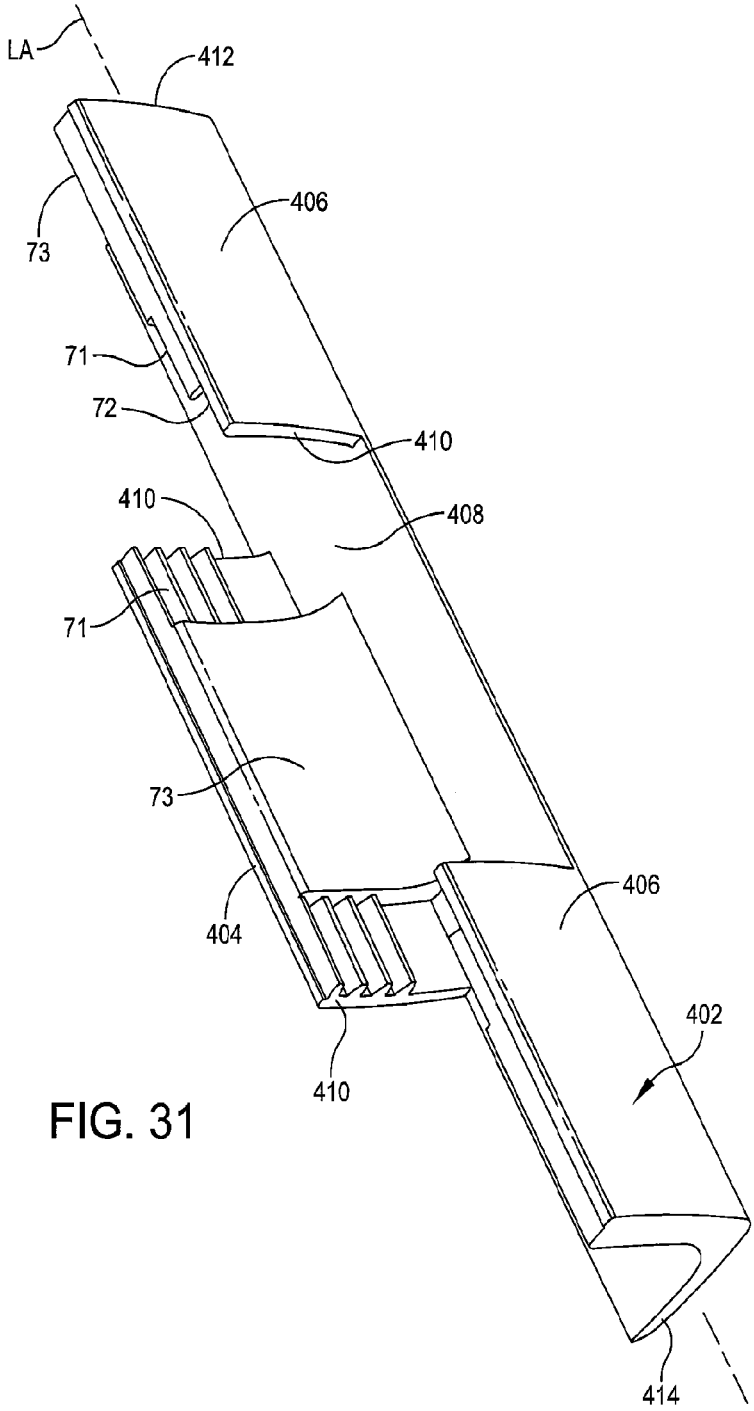
Figure 32:
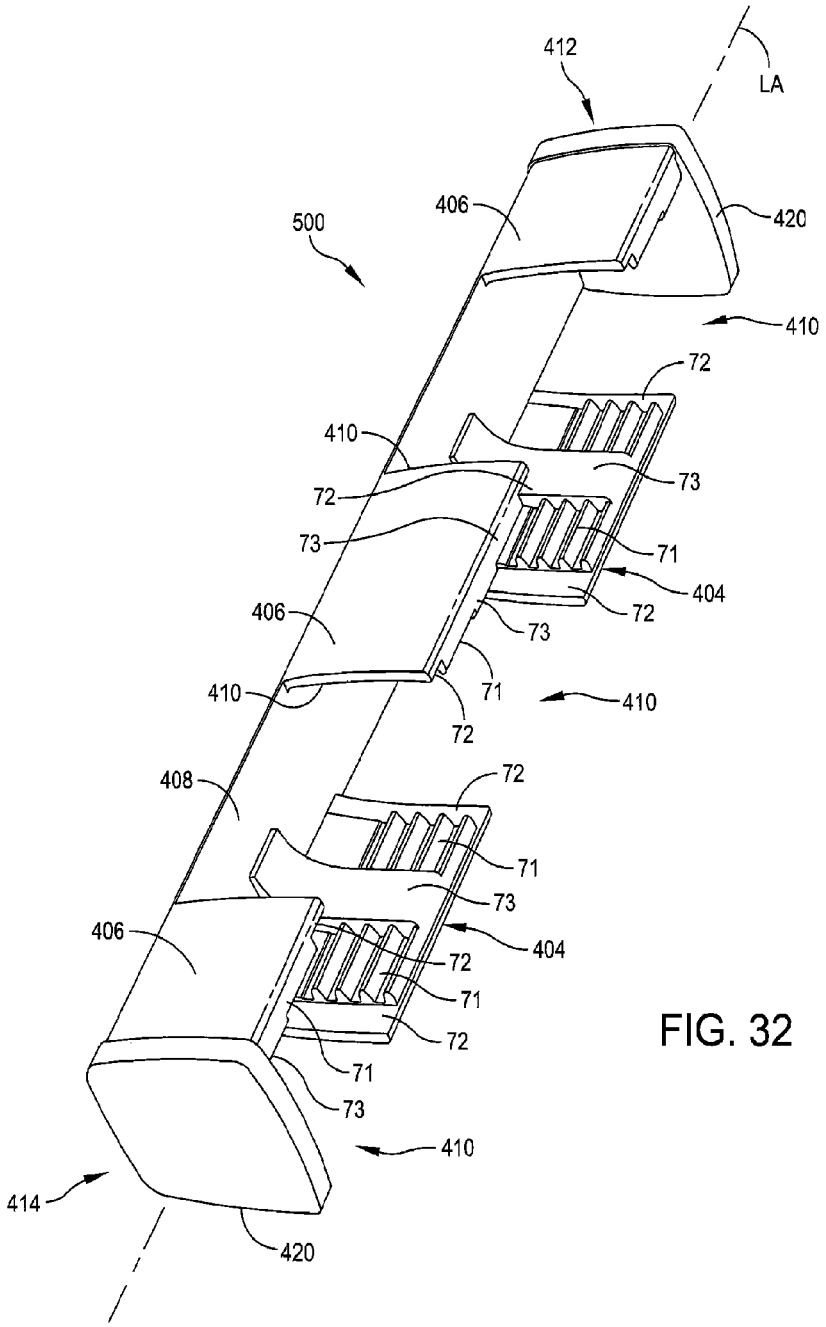
FIG. 32 is a perspective view of an alternative embodiment thereof having end caps.

FIGS. 30-32 show alternative embodiments of a one-piece of a cover adapter clip 400 and 500 having open sides. Cover adapter clip includes at least one, or two end caps 420 in some embodiments whereas cover adapter clip 400 does not include end caps. The construction of the sides of cover adapter clips 400 and 500 are different. Internally, these two cover adapter clips 400, 500 are essentially similar with respect to the gear racks 71, bearing locking grooves 72, and raised saddle or stop portions 73 which fit over the knuckles of the hinge except that the arrangement of these components varies somewhat as shown in the figures.

Advantageously, these clips 400, 500 may be molded as a single piece requiring no further joining members upon mounting to the hinge, can be easily released from the mold without use of more complex expensive style molds, and significantly uses less materials to provide comparable functionality to the other cover adapter clips disclosed herein. Cover adapter clips 400, 500 may be used with the pinned hinges, geared bearing inserts 30 or 40, and cover 60 previously described herein.

The embodiment of cover adapter clip 400 shown in FIGS. 30 and 31 does not include end caps, and can be used for either butt type pinned hinges or continuous type pinned hinges some of which are disclosed herein. Cover adapter clip 500 having two end caps 420 as shown in FIG. 32 is configured for mounting on a butt hinge. In other alternative embodiments contemplated, one end cap 420 may be provided to allow the cover adapter clip 500 be mounted on the top and bottom end portions of a continuous type pinned hinge to provide a neat appearance and closed ends. Accordingly, cover adapter clips 400, 500 will be described together in pertinent part.

Cover adapter clips 400 and 500 each have an axially elongated body including an outer surface 402 defined by one or more opposing sides 404, 406 and a top 408 spanning therebetween and connecting the sides together. Sides 404 and 406 depend from and are cantilevered from top 408 in term of structural support. Cover adapter clip 400 and 500 each further include opposing ends 412, 414 as shown. The sides 404, 406 and top 408 define a generally U-shaped member in transverse cross section similar to the other cover adapter clips described herein thereby forming an internal cavity configured for receiving portions of the hinge knuckles and geared bearing inserts as already describe herein.

In cover adapter clip 400 shown in FIGS. 30 and 31, two sides 406 are axially spaced apart along one lateral longitudinal edge of top 408 forming a lateral side window 410 therebetween on one side of the cover adapter clip. On the other lateral longitudinal edge of top 408, side 404 is disposed approximately midway between ends 412, 414 in one embodiment as shown and defines a pair of windows 410 each formed between the ends and side 404.

In cover adapter clip 500 shown in FIG. 32, three lateral sides 406 are axially spaced apart along one lateral longitudinal edge of top 408 forming a pair of a lateral side windows 410 therebetween as shown. On the other lateral longitudinal edge of top 408, two axially spaced apart sides 404 are disposed between ends 412, 414 in one embodiment as shown and define three windows 410; one window between the pair of sides 404 and one windows 410 each formed between the ends 412, 414 and each side 404.

In both embodiments of cover adapter clips 400 and 500 shown in FIGS. 30-32, the lateral sides 404 and 406 are longitudinally staggered in terms of arrangement on tops 408 so at any given axial position along longitudinal axis LA, there is only one side either 404 or 406 as depicted. In the exemplary but non-limiting arrangements shown, lateral sides 404, 406 are each disposed transversely or laterally opposite a window 410 on top 408. Because each gear segment 32 on geared bearing inserts 30 or 40 face in opposing lateral directions transverse to longitudinal axis LA, there is no need for a blank sidewall opposite the gear racks 71 which offers reduction in material usage and weight.

Cover adapter clips 400 and 500 are configured to receive cover 60 thereon in the same manner as previously described herein with respect to cover adapter clips 70, 90, and 210. In one embodiment, cover adapter clips 400 and 500 are made of molded polymer or plastic as already described herein.

Referring to FIGS. 30-32, cover adapter clips 400, 500 include similar operating and mounting elements as cover adapter clips 70, 90, and 210 as previously described, including gear racks 71, bearing locking grooves 72 which receive bearing portions 50 of geared bearing inserts 30 therein, and raised saddle or stop portions 73 which fit over the knuckles of the hinge in the same manner already described herein. In the embodiments shown, none of the gear racks 71 or locking grooves 72 are directly laterally opposing in arrangement, but longitudinally offset from one another. This contrasts to cover adapter clips 70, 90, and 210 wherein the gear racks 71 and grooves 72 are laterally opposing in arrangement in a longitudinal direction.

In the embodiment of cover adapter clip 500 shown in FIG. 32, this clip is configured similarly to cover adapter clip 210 (see FIGS. 22-25) for mounting on a five knuckle butt hinge such as butt hinge 200 (see, e.g. FIG. 22) having five stop portions 73 which correspond to the number of knuckles 16, 18. Because cover adapter clip 500 completely encloses all five knuckles, a stop portion 73 is provided on each end of the clip outboard of a gear rack 71 as shown. The five knuckle hinge 200 includes four axially spaced apart pairs of bearing inserts 30 and four corresponding locking grooves 72 are therefore provided which are interspersed between gear racks 71 as shown.

Cover adapter clip 400 shown in FIGS. 30-31 is configured for mounting on a three knuckle but hinge having two pairs of geared bearing inserts 30 or 40 (see, e.g. FIGS. 19A-19C), or alternatively to axially span three knuckles of a continuous type pinned hinge also having two pairs of geared bearing inserts.

It should be noted that one of the advantages of geared bearing inserts 30, 40 and cover adapter clip gear rack 71 construction disclosed herein is that articulates the adapter clip and its associated cover 60 mounted thereon is the maintenance of proper angular indexing of the cover with respect to the angular position of the leaves 13, 15 by providing gear segments 32 on all inserts 30, 40 having teeth with the same pitch diameter. For example, the cover system as shown and described herein with the same or equal gear teeth segment pitch diameter always bisects the angle formed by the angle of opening of the leaves 13, 15, thereby maintaining angular symmetry during hinge operation and articulation of the cover (see hinge opening sequence in FIGS. 17A-17C).

In another embodiment, a variation in the design and operation of the articulating cover 60 with respect to the hinge leaves 13, 15 in which the pitch diameter of one of the gear segments 32 of some of the geared bearing inserts 30, 40 facing one leaf is different from the pitch diameter of the gear segments of the geared bearing insert facing the opposing leaf, thereby permitting the angle of the cover that joins the geared leaves to rotate at a different rate with respect to one lateral side. This permits the angle of the cover with respect to the hinge leaves to favor one leaf side or the other leaf side during opening of the hinge and movement of the cover rather than always bisect the angle formed by the leaves as shown in FIGS. 17A-17C. This allows the attachment of a fin or projection to the cover that serves a secondary purpose, such a ridge that forms a secondary rib, projecting from the outer surface of the cover that seals against either the door or the frame when the hinge is in the fully open or fully closed position. Accordingly, this has the advantage that in certain hinge profiles, the cover angle could favor moving closer to one leaf than the other in order to provide extra clearance from a protruding or decorative frame projection, or other feature to allow proper opening/closing of the hinge without interference and binding.

While the foregoing description and drawings represent exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods or processes described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A pinned hinge with articulating cover system including:

a longitudinal axis;

a first hinge member including a first drive member mounted on the first hinge member;

a second hinge member including a second drive member mounted on the second hinge member;

a pin pivotally connecting the first and second hinge members together;

a cover adapter clip having a first driven member mechanically coupled to the first drive member and a second driven member mechanically coupled to the second drive member, wherein angularly opening and closing the first and second hinge members displaces the cover adapter clip with respect to the pin; and a cover mounted on the cover adapter clip and having a configuration complementary to the configuration of the cover adapter clip, the cover being movable with the clip.

2. The pinned hinge of claim 1, wherein the first drive member is a first geared bearing insert having a geared portion, the geared portion being engaged with the first driven member.

3. The pinned hinge of claim 2, wherein the first driven member is a first gear rack, the first gear rack being engaged with the geared portion of the first geared bearing insert.

4. The pinned hinge of claim 2, wherein the first geared bearing insert is mounted on a first knuckle of the first hinge member.

5. The pinned hinge of claim 4, further comprising a second geared bearing insert mounted on a second knuckle of the second hinge member, the second geared bearing insert having a geared portion engaged with the second driven member of the cover adapter clip.

6. The pinned hinge of claim 5, wherein the second driven member is a second gear rack engaged with the geared portion of the second geared bearing insert.

7. The pinned hinge of claim 5, wherein the geared portion of the first and second geared bearing inserts face in opposing directions transverse to the longitudinal axis of the hinge when the hinge is in a closed position.

8. The pinned hinge of claim 1, wherein the first drive member is mounted on a first knuckle of the first hinge member and includes a bearing portion, and the second drive member is mounted on a second knuckle of the second hinge member and includes a bearing portion, the bearing portions abuttingly contacting each other for supporting the hinge.

9. The pinned hinge of claim 8, wherein the opening and closing the first and second hinge members rotationally displaces the bearing portion of the first drive member with respect to the second drive member.

10. The pinned hinge of claim 9, wherein the first and second drive members each include a geared portion configured to engage the first and second driven members of the cover adapter clip respectively.

11. The pinned hinge of claim 1, wherein the cover is axially elongated and includes a longitudinally-extending cavity configured and dimensioned to receive the cover adapter clip at least partially therein.

12. The pinned hinge of claim 11, wherein the cover is resiliently constructed and operable to expand when laterally pushed onto the cover adapter clip and contract when fully seated on the cover adapter clip to provide a snap fit.

13. The pinned hinge of claim 12, wherein the cover is made of sheet metal having lateral flexibility in a direction oriented transverse to the longitudinal axis of the hinge and the pin.

14. The pinned hinge of claim 1, wherein the hinge is a continuous hinge wherein the first hinge member includes at least four axially spaced apart knuckles and the second hinge member includes at least three axially spaced apart knuckles interspersed between the knuckles of the first hinge member.

15. A pinned hinge with articulating cover system including:

a longitudinal axis; a first hinge member including a first leaf having at least a first knuckle;

a second hinge member including a second leaf having at least two second and third knuckles, the first knuckle of the first hinge member being interspersed between the second and third knuckles;

a pin pivotally connecting the first and second hinge members together for pivoting opening and closing movement;

a first pair of adjacent geared bearing inserts disposed between a first end of the first knuckle and the second knuckle, each geared bearing insert of the first pair being removably mounted to the first or second knuckles and including a toothed geared portion and a bearing portion;

a second pair of adjacent geared bearing inserts disposed between a second end of the first knuckle and the third knuckle, each geared bearing insert of the second pair being removably mounted to the first or third knuckles and including a toothed geared portion and a bearing portion;

an elongated cover adapter clip including a plurality of toothed gear racks mechanically coupled to first and second hinge members by engagement with the geared bearing inserts, wherein angularly opening and closing the first and second hinge members displaces the cover adapter clip with respect to the pin; and an elongated cover mounted on the cover adapter clip and being movable with the clip.

16. The pinned hinge of claim 15, wherein the bearing portions of the geared bearing inserts in each pair of geared bearing inserts are in abutting contact with each other.

17. The pinned hinge of claim 16, wherein the bearing portions each include a planar annular bearing surface having a central aperture configured to receive the pin therethrough, the annular bearing surfaces between adjacent pairs of geared bearing inserts being in abutting sliding rotational contact.

18. An articulating cover system for a pinned hinge, the system comprising:

a plurality of geared bearing inserts, each geared bearing insert configured for detachable mounting on a knuckle of a hinge leaf and including a geared portion comprising a gear tooth segment and a bearing portion having an annular load bearing surface;

at least one cover adapter clip having a substantially U-shaped body in cross section defining an open bottom and a central cavity configured for receiving the geared bearing inserts, the cover adapter clip including a plurality of gear tooth racks configured for movable coupling to the geared portions of the geared bearing inserts, wherein rotation of at least some of the geared bearing inserts when mounted on knuckles of the hinge leaf displaces the cover adapter clip with respect to the geared bearing inserts; and a cover configured for detachable mounting on the cover adapter clip and having a complementary shape substantially conforming to the cover adapter clip.

19. The system of claim 18, wherein the cover adapter clip further includes a bearing locking groove configured to receive the bearing portions of the geared bearing inserts.

20. The system of claim 18, further comprising a raised stop portion configured and dimensioned to fit over a knuckle of a hinge leaf.

21. The system of claim 18, wherein the bearing portion has a diameter that is at least coextensive with a tip diameter of the toothed gear segment of the geared portion.

22. The system of claim 18, wherein the gear segment geared portion is arcuately shaped and comprised a plurality of teeth protruding radially outwards from the geared bearing insert.

23. The system of claim 18, wherein the cover adapter clip is formed of two half pieces joined together along a longitudinally extending seam between the half pieces.

24. The system of claim 23, wherein each half piece includes a tab and recess for securing the halves together.

25. The system of claim 18, wherein the cover adapter clip is one-piece of unitary monolithic construction and includes open sides each disposed laterally opposite at least one gear rack.

26. The system of claim 18, wherein the cover adapter clip includes at least one end cap formed as a unitary structural part of the clip.

27. The system of claim 18, wherein at least one of the geared bearing inserts and cover adapter clip are made of plastic.

28. A method for attaching a cover system to a pinned hinge including:

providing a first hinge member having a pair of spaced apart first and second knuckles defining an axial passageway configured for receiving a hinge pin;

providing a second hinge member having a third knuckle defining an axial passageway configured for receiving a hinge pin;

providing a plurality of geared bearing inserts each having a geared portion comprising gear teeth and an integral bearing portion comprising an annular load bearing surface;

mounting a geared bearing insert on each of opposite ends of the third knuckle of the second hinge member;

mounting a gear bearing insert on an end of each of the first and second knuckles that is proximate most to the other knuckle of the first hinge member;

inserting the third knuckle of the second hinge member between the first and second knuckles of the first hinge member, wherein the geared bearing inserts on each end of the third knuckle are adjacent to one of the geared bearing inserts on the first or second knuckle;

aligning the passageways of the first and second knuckles with the passageway of the third knuckle;

axially inserting a hinge pin through the first, second, and third knuckles;

engaging a cover adapter clip having a plurality of gear racks with the geared bearing inserts on the hinge; and attaching a resiliently configured snap-on cover onto the cover adapter clip.

29. The method of claim 28, wherein the cover adapter clip has a resiliently open bottom defining an internal cavity and the first attaching step includes laterally pushing the clip over the knuckles and geared bearing inserts.

30. The method of claim 28, wherein the second attaching step includes pushing and laterally expanding the cover over the cover adapter clip.

* * * * *